US011199068B2

(12) United States Patent
Inyang et al.

(10) Patent No.: US 11,199,068 B2
(45) Date of Patent: Dec. 14, 2021

(54) REAL-TIME PERFORATION PLUG DEPLOYMENT AND STIMULATION IN A SUBSURFACE FORMATION

(71) Applicant: Halliburton Energy Services, Inc., Houston, TX (US)

(72) Inventors: Ubong Inyang, Humble, TX (US); Joshua Lane Camp, Friendswood, TX (US); Tyler Austen Anderson, Rock Springs, WY (US); Jim Basuki Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 6 days.

(21) Appl. No.: 16/644,652

(22) PCT Filed: Dec. 13, 2017

(86) PCT No.: PCT/US2017/066209

§ 371 (c)(1),
(2) Date: Mar. 5, 2020

(87) PCT Pub. No.: WO2019/117900

PCT Pub. Date: Jun. 20, 2019

(65) Prior Publication Data

US 2021/0040813 A1 Feb. 11, 2021

(51) Int. Cl.
*E21B 47/11* (2012.01)
*E21B 33/13* (2006.01)

(52) U.S. Cl.
CPC ..... *E21B 33/13* (2013.01); *E21B 47/11* (2020.05)

(58) Field of Classification Search
None
See application file for complete search history.

(56) References Cited

U.S. PATENT DOCUMENTS

| | | | |
|---|---|---|---|
| 4,287,952 | A | 9/1981 | Erbstoesser |
| 4,505,334 | A | 3/1985 | Doner et al. |
| 6,070,666 | A | 6/2000 | Montgomery et al. |
| 7,451,812 | B2 | 11/2008 | Cooper et al. |

(Continued)

FOREIGN PATENT DOCUMENTS

| | | | |
|---|---|---|---|
| WO | 2016022252 | A1 | 2/2016 |
| WO | 2016137448 | A1 | 9/2016 |
| WO | 2017052499 | A1 | 3/2017 |

OTHER PUBLICATIONS

PCT Application Serial No. PCT/US2017/066209, International Search Report, dated Sep. 6, 2018, 3 pages.

(Continued)

*Primary Examiner* — Andrew Sue-Ako
(74) *Attorney, Agent, or Firm* — Gilliam IP PLLC

(57) ABSTRACT

A flow distribution may be monitored to one or more clusters of perforations. Plugging criteria may be identified based on the flow distribution and characteristics associated with perforation plugs to be dropped into a wellbore associated with the subsurface formation may be determined based on the flow distribution, characteristics of the one or more clusters, and the plugging objective. The perforation plugs may be dropped into the wellbore. The perforation plugs may have tracers which indicate whether the perforation plugs reached a location associated with the one or more clusters.

20 Claims, 8 Drawing Sheets

(56) References Cited

U.S. PATENT DOCUMENTS

| | | | | |
|---|---|---|---|---|
| 2009/0218094 | A1 | 9/2009 | McLeod et al. | |
| 2011/0088462 | A1 | 4/2011 | Samson et al. | |
| 2014/0022537 | A1 | 1/2014 | Samson et al. | |
| 2014/0034309 | A1 | 2/2014 | Saini et al. | |
| 2014/0224493 | A1 | 8/2014 | Soliman et al. | |
| 2015/0129203 | A1 | 5/2015 | Deutch et al. | |
| 2015/0144333 | A1 | 5/2015 | Lee et al. | |
| 2016/0003017 | A1 | 1/2016 | Keller et al. | |
| 2016/0201427 | A1 | 7/2016 | Fripp et al. | |
| 2017/0205526 | A1 | 7/2017 | Meyer | |
| 2019/0145233 | A1* | 5/2019 | Karale | G01V 99/005 702/6 |
| 2019/0249542 | A1* | 8/2019 | Madasu | E21B 43/14 |

OTHER PUBLICATIONS

PCT Application Serial No. PCT/US2017/066209, International Written Opinion, dated Sep. 6, 2018, 8 pages.

PCT Application Serial No. PCT/US2017/066224, International Search Report, dated Sep. 11, 2018, 4 pages.

PCT Application Serial No. PCT/US2017/066224, International Written Opinion, dated Sep. 11, 2018, 12 pages.

U.S. Appl. No. 16/644,794, Restriction Requirement, dated Feb. 23, 2021, pages.

"Diversion in Matrix-Acidizing Treatments", [online] retrieved on Mar. 10, 2021 from https://www.halliburton.com/content/dam/ps/public/pe/contents/Best_Practices/web/A_through_G/F3354.pdf, Oct. 21, 2008, 20 pages.

Brown, et al., "Factors Influencing Optimum Ball Sealer Performance", Society of Petroleum Engineers, Journal of Petroleum Technology 15 (04): pp. 450-454, Paper No. SPE-553-PA, Apr. 1, 1963.

Erbstoesser, "Improved Ball Sealer Diversion", Society of Petroleum Engineers, Journal of Petroleum Technology 32 (11): pp. 1903-1910; Paper No. SPE-8401-PA, Nov. 1980.

Gabriel, et al., "The Design of Buoyant Ball Sealer Treatments", Society of Petroleum Engineers, SPE Annual Technical Conference and Exhibition, Houston, Texas, Sep. 1984, Paper No. SPE-13085-MS, 12 pages.

CA Application No. 3074010, First Office Action, dated Apr. 20, 2021, 5 pages.

U.S. Appl. No. 16/644,794, Non-Final Office Action, dated May 7, 2021, 13 pages.

* cited by examiner

REAL-TIME PERFORATION PLUG DEPLOYMENT AND STIMULATION IN A SUBSURFACE FORMATION

FIELD OF USE

The disclosure generally relates to the field of hydrocarbon production, and more particularly to deploying perforation plugs and stimulating a subsurface formation based on real-time measurement to reach hydrocarbon deposits.

BACKGROUND

During hydrocarbon production, selective establishment of fluid communication can be created between a wellbore and a subsurface formation. The wellbore may be lined with a casing, liner, tubing, or the like. Fluid communication can be established by creating one or more perforations by placing high-explosive, shaped charges in the wellbore. The shaped charges can be detonated at a selected location, which penetrates a casing, liner, tubing of the wellbore, and/or formation rock, thereby forming the perforations.

Certain of the perforations are then stimulated to reach hydrocarbon deposits. Treatment fluid is injected into the subsurface formation via the perforations at high pressures and/or rates. The treatment fluid has various stimulation additives, e.g., particulates of varying sizes, mixed with a hydraulic fluid such as water frac or slick water frac. The various simulation additives in the treatment fluid injected at the high pressures and/or rates initiate, propagate, and/or prop fractures within the subsurface formation to a desired extent.

Stimulation treatment can be performed in stages and include a diverter stage. The diverter stage involves dropping diverter material into a wellbore after a first stimulation treatment and before a second stimulation treatment. The diverter material is deployed as a chemical mixture. Examples of such diverter material include, but are not limited to, viscous foams, particulates, gels, benzoic acid and other chemical diverters. Diverter material causes certain of the perforations to be plugged up such that during further stimulation after the diverter stage treatment fluids flows toward perforations that are receiving inadequate treatment to effect fracturing at those perforations.

BRIEF DESCRIPTION OF THE DRAWINGS

Embodiments of the disclosure may be better understood by referencing the accompanying drawings.

DESCRIPTION

Figure 1:
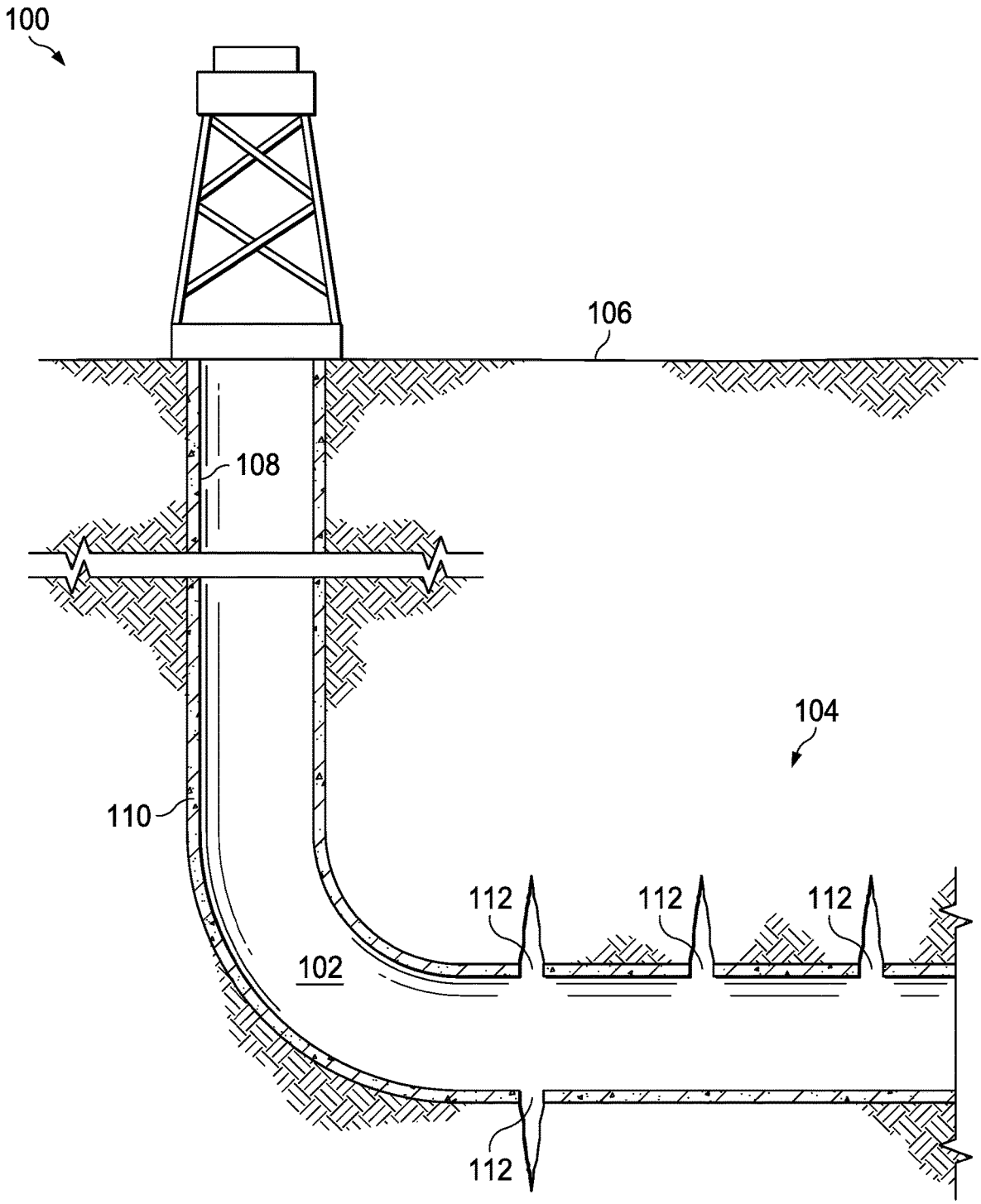
FIG. 1 is a diagram of an illustrative well system.

Perforations may be formed in a wall of a wellbore. In some cases, the wall of the wellbore may be lined with a casing, liner, and/or tubing having perforations to access the subsurface formation. The formation may then be stimulated through the perforations. For example, the stimulation may involve injecting treatment fluid into the perforations into the subsurface formation to initiate, grow, and/or prop fractures in the subsurface formation. The fractures may include natural fractures, main fractures, secondary fractures, and microfractures, among others.

The treatment fluid may be a mixture of a stimulation additive and hydraulic fluid. Conventionally, a concentration of the stimulation additive in the treatment fluid may be determined for each zone of the well before stimulation begins. Further, the diverter material to be dropped may also be determined before the stimulation begins. The stimulation may be performed based on the concentration of the stimulation additives and/or diverter material determined beforehand without accounting for the fact that subsurface formation properties may change as the subsurface formation is stimulated and the diverter material is dropped.

In embodiments, real-time measurements obtained from one or more data sources may be used to monitor the downhole flow distribution to facilitate dropping of the diverter material and/or or stimulating the subsurface formation. The real-time measurements may improve efficiency in the use of the diverter material, stimulation additives, and effectiveness of the fracturing operation.

In one example, the real-time measurements may be used to define a perforation plugging objective which describes how to change the flow distribution of treatment fluid injected downhole during stimulation. For example, the perforation plugging objective may indicate that treatment fluid which is directed to some perforations may be diverted toward other perforations to result in desired fracturing. The diversion may be achieved using diverter material in the form of perforation plugs which wedge and/or plug perforations which in turn causes the flow distribution in the wellbore to change.

Selection of the perforation plugs may be based on known characteristics of the perforation, including at least one of a size, density, shape, location, and flow distribution in the wellbore. Further, in some examples, a model may be used to select the perforation plugs to achieve the perforation plugging objective. The selected perforation plugs may be made of different materials which could be degradable or non-degradable.

The selected perforation plugs may be dropped into the wellbore. Dropping describes any process of adding perforation plugs into the wellbore from the surface and/or downhole. The perforation plugs may have a tracer which indicates where the perforation plug is located. Using the tracers, positions of the perforation plugs may be monitored in real time to determine a flow distribution downhole and whether the perforation plugs reached the cluster to be plugged. A determination may be made whether the perforation plugging objective is met. If the perforation plugging objective is met, then the flow distribution may be continued to be monitored until a need arises to adjust the flow again. If the perforation plugging objective is not met, then the new plugging objectives may be determined, additional perforation plugs selected, and the additional perforation plugs may be dropped. This process may be repeated until the plugging objectives are met. The ability to precisely select the perforation plugs in accordance with flow distribution allows wellsite operators to reduce the amount of time and materials needed for hydrocarbon production using fracturing, thereby reducing the overall costs.

In another example, the real-time measurements may also be used to define a stimulation objective which also describes how to change the flow distribution of treatment fluid injected downhole. The stimulation objective may take various forms. For example, if the flow distribution indicated during the dropping of perforation plugs is relatively uniform, then the simulation objective might be to prop microfractures of the fractures already formed. If the flow is not uniform, then the stimulation objective might be to initiate or reinitiate new fractures to make the flow distribution more uniform. Additionally, or alternatively, the stimulation objective might be to reduce wellbore tortuosity and/or control leakoff in the subsurface formation. Other stimulation objectives are also possible.

Based on the stimulation objective, stimulation parameters may be identified. The simulation parameters may identify characteristics of the treatment fluid for stimulating the subsurface formation. For example, the stimulation parameters may identify a type of hydraulic fluid and volume of the hydraulic fluid to be used in the subsequent stimulation treatment. Additionally, or alternatively, the stimulation treatment may identify a stimulation additive. The stimulation additive may be an ultrafine particulate added to the hydraulic fluid. The stimulation parameter may also identify an amount of the stimulation additive to mix with the hydraulic fluid to achieve a certain concentration in a volume of treatment fluid. The treatment fluid may be injected from the surface of the subsurface formation and/or downhole. The flow distribution may be again monitored via real-time measurements. A determination may be made whether the stimulation objective is met. If the stimulation objective is met, then the flow distribution may continue to be monitored until a need arises to adjust the flow distribution again. If the stimulation objective is not met, then a new stimulation objective may be determined, additional stimulation parameters defined, and the subsurface formation further stimulated. The ability to make real time decisions also improves efficiency in use of the stimulation additives and hydraulic fluid and effectiveness of fracturing operation.

The description that follows includes example systems, apparatuses, and methods that embody aspects of the disclosure. However, it is understood that this disclosure may be practiced without these specific details. For instance, this disclosure refers to perforation plug deployment for hydrocarbon production in illustrative examples. Aspects of this disclosure can be also applied to any other applications requiring perforation plug deployment. In other instances, well-known instruction instances, structures and techniques have not been shown in detail in order not to obfuscate the description.

Example System

Illustrative embodiments and related methodologies of the present disclosure are described below in reference to the examples shown in FIGS. 1-8 as they might be employed, for example, in a computer system for deploying perforation plugs, real-time monitoring of the deployment of the perforation plugs, delivering treatment fluid composed of a stimulation fluid and stimulation additive, and real-time monitoring of the delivery of the treatment fluid.

Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented. While these examples may be described in the context of stimulation treatment via fluid injection to cause fracturing, it should be appreciated that the deployment of perforation plugs and real-time monitoring of the deployment for purposes of fracturing are not intended to be limited thereto. These techniques may be applied to other types of stimulation treatments such as matrix acidizing treatments.

FIG. 1 is a diagram illustrating an example of a well system 100. As shown in the example of FIG. 1, well system 100 includes a wellbore 102 in a subsurface formation 104 beneath a surface 106 of a wellsite. Wellbore 102 as shown in the example of FIG. 1 includes a horizontal wellbore. However, it should be appreciated that embodiments are not limited thereto and that well system 100 may include any combination of horizontal, vertical, slant, curved, and/or other wellbore orientations. The subsurface formation 104 may include a reservoir that contains hydrocarbon resources, such as oil, natural gas, and/or others. For example, the subsurface formation 104 may be a rock formation (e.g., shale, coal, sandstone, granite, and/or others) that includes hydrocarbon deposits, such as oil and natural gas. In some cases, the subsurface formation 104 may be a tight gas formation that includes low permeability rock (e.g., shale, coal, and/or others). The subsurface formation 104 may be composed of naturally fractured rock and/or natural rock formations that are not fractured initially to any significant degree.

The wellbore may also have example perforations 112 or generally entry points into the subsurface formation 104. In some examples, the wellbore 102 may be lined with a casing 108 and cement 110 and the perforations 112 may provide fluid communication between the casing 108 and cement 110 and the subsurface formation 104. In other examples, the wellbore may be not lined with cement, in which case the perforations may provide fluid communication between the casing and the subsurface formation 104. The perforations 112 may be formed in a variety of manners.

For example, a perforation gun may be inserted into an interior of the wellbore 102 at a certain location. The perforation gun may be further oriented at different directions within the wellbore and fire shaped charges capable of penetrating the casing 108 (and cement 110) to provide fluid communication with the subsurface formation 104. The firing of the shaped charges may form a cluster of perforations. The perforation gun may be fired with a known quantity of shaped charges, with a known shape, and with a known amount of explosives. For example, the shaped charge may take the form of a cone with a thin shell and explosives inside that cause a focused explosion (e.g., jetting of solids, liquids, and/or gases under high pressure) toward the casing 108 to form the perforations. The firing may result in a known shape, size, and density of the perforations. For example, the perforations may be round with a diameter of 0.4 to 0.5 inches at a density of 12 perforations per square foot. The perforations may be formed in 0, 45, or 60 degree phasings as examples. This process may be repeated to form a plurality of clusters of perforations in the wellbore 102.

In other examples, the perforation may be formed with projectiles such as shots or bullets that impact the casing 108 to form the perforation. In yet other examples, the casing 108 may already have perforations already formed in it, in which case the perforations do not need to be formed at all.

Figure 2:
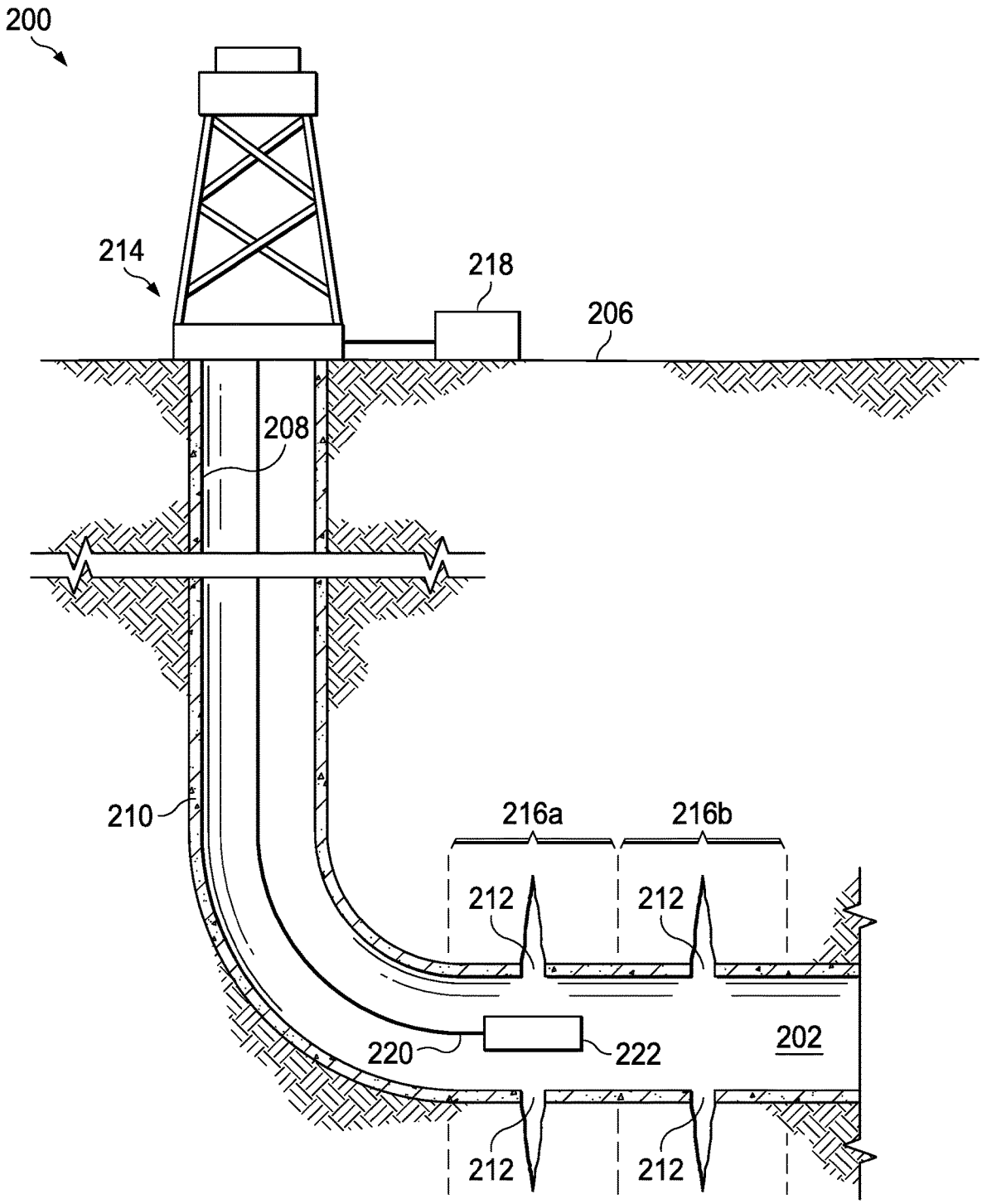
FIG. 2 is a diagram of an illustrative well system arranged with apparatus for performing stimulation treatment.

FIG. 2 is a diagram illustrating an example well system 200 arranged with apparatus for performing stimulation treatment. Stimulation treatment is a process of injecting treatment fluid into the formation to initiate, grow, and/or prop fractures in the subsurface formation The fractures may include natural fractures, main fractures, secondary fractures, and/or microfractures, among others. Well system 200 is arranged in a manner similar to that of well system 100 with a wellbore 202, in a subsurface formation 204 beneath a surface 206. The wellbore 202 may be lined with a casing 208 and cement 210 and have perforations 212. The well system 200 may further include a fluid injection system 214 for injecting treatment fluid, e.g., hydraulic fracturing fluid, into the subsurface formation 204 over multiple zones, e.g., 216*a*, 216*b* (collectively referred to herein as "zones 216") of the wellbore 202. Each of the zones 216*a-b* may correspond to, for example, a different stage or interval of the stimulation treatment. Boundaries of the respective zones 216 may be delineated by, for example, locations of bridge plugs, packers and/or other types of equipment in the wellbore 202 such that any injected treatment fluid during the stage of stimulation treatment is limited to the respective section. It should be appreciated that any number of zones 216 may be used as desired for a particular implementation and the two zones 216 shown in FIG. 2 is exemplary. Furthermore, each of the zones 216 may have different widths or may be uniformly distributed along the wellbore 202.

As shown in FIG. 2, injection system 214 includes an injection control subsystem 218, a signaling subsystem 220, and one or more injection tools 222 installed in the wellbore 202. The injection tools 222 may include numerous components including, but not limited to, valves, sliding sleeves, actuators, ports, and/or other features that communicate treatment fluid from a working string disposed within the wellbore 202 into the subsurface formation 204 via the perforations.

The treatment fluid may be injected into the wellbore 202 through any combination of one or more valves and orifices of the injection tools 222. The injection of treatment fluid by the injection system 214 into the wellbore 202 may alter stresses in the subsurface formation 204, particularly, at the perforations 212, and create a multitude of fractures 224 in the subsurface formation 204 at the perforations 212. The stresses may be altered via various stimulation additives in the treatment fluid such as sand, bauxite, ceramic materials, glass materials such as microsilica, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, lightweight particulates, microsphere plastic beads, ceramic microspheres, glass microspheres, manmade fibers, cement, fly ash, carbon black powder, and combinations thereof to create the fractures. The stimulation additives may initially take the form of a dry add or pellets which is batch mixed with a liquid such as a xanthan polymer to form a concentrated slurry. The concentrated slurry may then be delivered downhole via the injection system 214 using various methods to form the treatment fluid for stimulation of the formation.

In one example, the slurry may be injected using a centrifugal pump or high rate liquid additive pump. The slurry may be injected into a suction of the pump which causes the slurry to be injected to lines that lead to a well head along with hydraulic fluid such as water frac or slickwater frac to form the treatment fluid. "Waterfrac" treatments employ the use of low cost, low viscosity fluids in order to stimulate very low permeability reservoirs. Additionally, or alternatively, the slurry may be injected into a suction of the pump which causes the slurry to be injected into the well head directly along with the hydraulic fluid to form the treatment fluid. Still additionally, or alternatively, the slurry may be injected into a suction of the pump which causes the slurry along with the hydraulic fluid to be injected downstream of the well head or to an injection line which is attached to an inside or outside diameter of a work string or casing to form the treatment fluid. The injector line may run a length of the work string or casing. In some cases, the slurry may be mixed by a mixer before being injected downhole.

In a second example, a downhole mixing assembly may be used to mix the slurry with the hydraulic fluid to form the treatment fluid. The treatment fluid may be pumped downhole using a coiled tubing (CT).

In a third example, the slurry may be delivered into the wellbore using jointed tubing or a combination of jointed tubing and coil tubing along with the hydraulic fluid to form the treatment fluid. Other examples are also possible for forming the treatment fluid downhole.

The injection control subsystem 218 can communicate with the injection tools 222 from the surface 206 of the wellbore 202 via the signaling subsystem 220. Injection system 214 may include additional and/or different features. For example, the injection system 214 may include any number of computing subsystems, communication subsystems, pumping subsystems, monitoring subsystems, and/or other features as desired for a particular implementation. In some implementations, the injection control subsystem 218 may be communicatively coupled to a remote computing system (not shown) for exchanging information via a network for purposes of monitoring and controlling wellsite operations, including operations related to the stimulation treatment. Such a network may be, for example and without limitation, a local area network, medium area network, and/or a wide area network, e.g., the Internet.

The injection tools 222 may also include one or more sensors. The one or more sensors may be used to collect data relating to operating conditions and subsurface formation characteristics along the wellbore 202. Such sensors may serve as real-time data sources for various types of measurements and diagnostic information pertaining to each stage of the stimulation treatment. Examples of such sensors include, but are not limited to, chemical sensors, microseismic sensors, tiltmeters, pressure sensors, and other types of downhole sensing equipment. The data collected downhole by such sensors may include, for example, real-time measurements and diagnostic data for monitoring the extent of fracture growth and complexity within the subsurface formation 204 along the wellbore 202 during each stage of the stimulation treatment, e.g., corresponding to one or more sections 216. In some implementations, the injection tools 222 may include fiber-optic sensors. For example, the fiber-optic sensors may be components of a distributed acoustic sensing (DAS), distributed strain sensing, and/or distributed temperature sensing (DTS) subsystems of the injection system 214. The injection tools 222 may be moved within the wellbore to position the fiber optic sensors to collect real-time measurements of acoustic intensity or thermal energy downhole during the stimulation treatment at desired locations. However, it should be appreciated that other types of measurements may also be collected by the injection tools 222.

The data collected downhole by one or more of the aforementioned data sources may be provided to the injection control subsystem 218 for processing. The signaling subsystem 220 may receive the data and transmit the data to the injection control subsystem 218. Thus, in the fiber-optics example above, the downhole data collected by the fiber-optic sensors may be transmitted to the injection control subsystem 218 via, for example, fiber optic cables included within the signaling subsystem 220.

A wellbore isolation device, such as a fracture plug, may be disposed at a zone boundary of a zone of the wellbore. For example, two fracture plugs may be positioned a distance apart in the wellbore within a zone. The two fracture plugs may isolate the zone from other, adjacent zones and/or from other portions of the wellbore so as to pressurize the treatment fluid injected into the zone.

The zone may often have multiple clusters of perforations which are stimulated to produce fractures during the stimulation treatment. However, some of the clusters may accept much more fluid than other clusters. Perforation plugs or generally plugs, as described in more detail below, can be used to seal the perforations of certain clusters to affect the fracturing process. For example, clusters which are accepting a larger quantity of fluid may be plugged. This action serves to direct the treatment fluid into the clusters that do not have perforation plugs, enlarging the fractures associated with those clusters. The clusters may be plugged in other ways as well.

Figure 3:
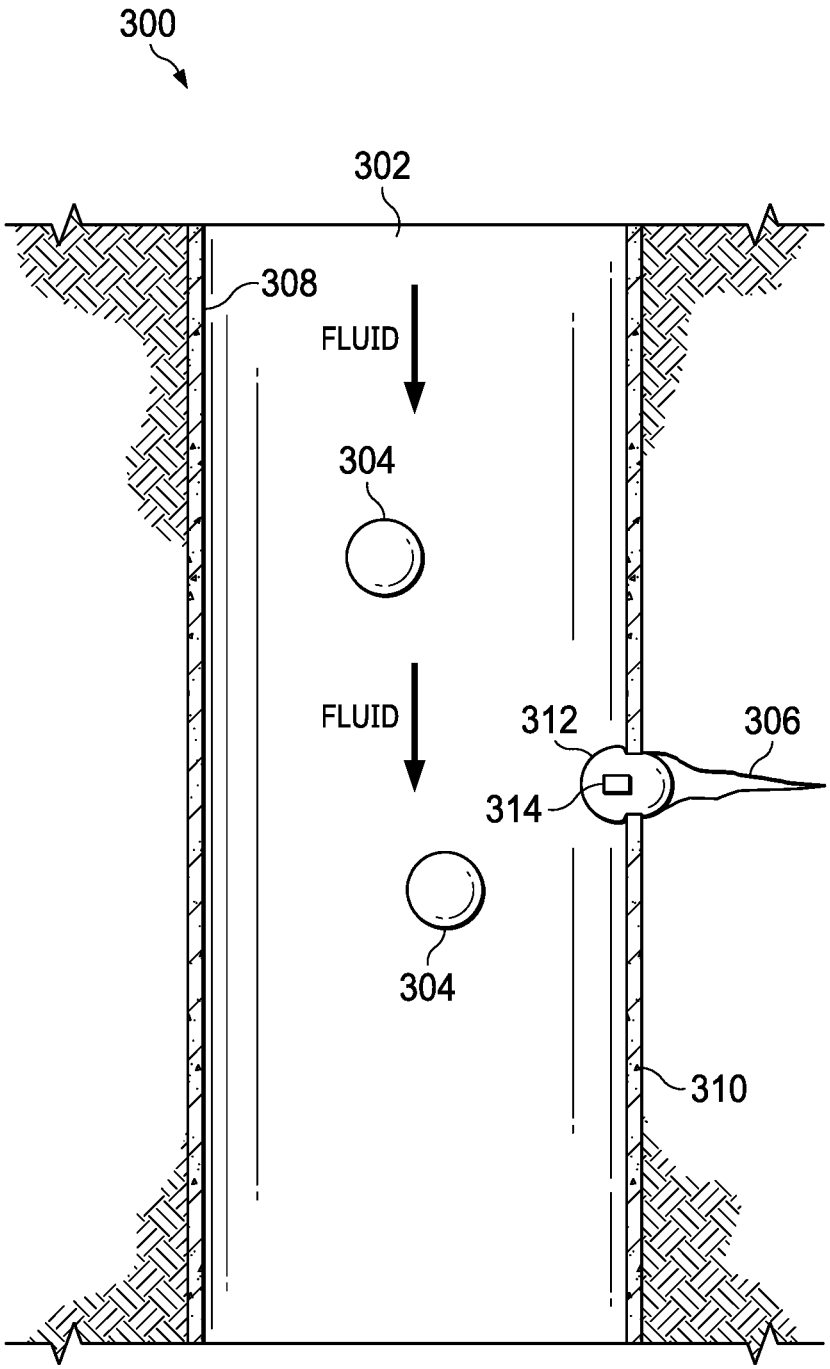
FIG. 3 is an example schematic view of perforation plugs deployed downhole in a subsurface formation.

FIG. 3 illustrates a schematic view of a well 300 with wellbore 302. The wellbore 302 may further have a perforation 306. The perforation 306 may be through a casing 308 of the wellbore 302 and in some cases through cement 310 of the example wellbore 302 when present.

The wellbore 302 may have a plurality of perforation plugs 304. The perforation plugs 304 may be produced from a variety of materials such as nylon, poly-lactic acid (PLA), poly-vinyl alcohol (PVA), poly-vinyl acetate (PVAc), aluminum, foam, and polymers, in different shapes, diameters, and densities. In some instances, the perforation plug 304 may be partially or completely dissolvable. For example, a solvent may be injected into the wellbore to dissolve the perforation plug 304. The use of dissolvable perforation plugs 304 negate the need to execute an extraction operation to remove to the perforation plugs 304 from the wellbore after the stimulation treatment is complete and before hydrocarbons are extracted from the fractures. The perforation plugs 304 may be conveyed into the wellbore 302 in a variety of manners. For example, perforation plugs 304 may be injected by the injection tools into the wellbore 302. In some case, the perforation plugs 304 may be injected into a zone of the wellbore defined by well isolation devices.

The treatment fluid in the wellbore 302 may flow in the wellbore, e.g., zone, in accordance with a flow distribution. The flow distribution may be indicative of how the fluid flows in the subsurface formation, e.g., direction, rate to a cluster. The perforation plugs 304 which are injected into the wellbore 302 may flow in accordance with the flow distribution. Ideally, the perforation plugs 304 which are dropped into the wellbore 302 may become wedged into the perforation 306 thereby sealing off the perforation 306. A wedged perforation plug is shown as perforation plug 312. Further, the perforation plug 312 may remain in place in the perforation 306 by holding pressure gradient in a radial direction in the perforation 306. In general, perforation plugs 312 may tend to be pulled into perforations taking (the most) fluids, however, in some cases, the perforation plug 312 may pushed into the perforation rather than being pulled into the perforations. For example, a perforation plug 312 might be pulled in by a perforation 306 at a first location, accelerate towards that perforation 306, but miss it and bounce off the wellbore. The perforation plug 312, based on its momentum, may be pushed into another perforation at a second location, e.g., below the first location. Other variations are also possible.

The well 300 shows example of a single perforation plug plugging a single perforation in a vertical section of the wellbore 302. In practice, the well 300 may have a plurality of clusters of perforations in a horizontal, vertical, or angular section of the wellbore 302, and each cluster may have a plurality of perforations. At least a portion of the perforations in a cluster of the one or more of the clusters may be plugged. The cluster may be plugged by dropping a plurality of perforation plugs into the wellbore. The plurality of perforation plugs may flow to the cluster and plug the perforations in the cluster. Further, in some instances, a perforation of the cluster may be plugged with multiple perforation plugs. The perforation may be plugged with multiple perforation plugs when a size of the perforation plug is smaller than the perforation and more than one perforation plug can wedge into the perforation at a time. Other variations are also possible.

In some examples, the perforation plug 312 may have a tracer 314. The tracer may be integral with the perforation plug 312 and take a variety of forms. For instance, the tracer 314 can include a radio-frequency identification (RFID) unit, a near field communication (NFC) unit or any other suitable radio or wireless transmission methods or electronic systems which outputs radio or wireless signals which uniquely identifies the tracer 314. Additionally, or alternatively, the tracer 314 can include an acoustic output device. The acoustic output device may output acoustic signals via a transducer driven by an electronic circuit. The acoustic signals may be output in a predefined frequency range. The signals may be received by sensors such as surface listening devices or downhole listening devices such as fiber optic sensors of the injection tools. Additionally, or alternatively, tracer may be a chemical and the signal may take the form of an emitted chemical from the tracer 314 that is then detected by sensors sensitive to the chemical. The chemical may be emitted, for example, when the tracer dissolves from the perforation plug. The tracer 314 may output other signals instead of or in addition to the acoustic signal, including light and/or a pressure signal, among others, as described in more detail below.

In some examples, the tracer 314 can also include a sensor and memory for recording properties of the wellbore environment, such as pressure, temperature, fluid composition, fluid flow, and other environmental, physical, and chemical parameters (different from the chemical associated with the tracer) as the perforation plugs flows in the wellbore 302. For instance, the tracer 314 can detect or identify the fluid composition via measurements based on electrical resistivity, capacitance, inductance, magnetic permittivity, permeability, resonant frequency of inductance of surround fluid, resistance-capacitance decay, etc. To facilitate retrieval of the recorded properties, the tracer 314 may be in a buoyant, protective, non-dissolvable packaging which dissolves from the perforation plug 304 when the perforation plug 304 reaches a perforation 312. The perforation plug 304 may be sensitive to specific chemicals present at the perforation 312 which causes the dissolution of the packaging from the perforation plug 304. The specific chemicals may be oil, aqueous medium or a mixture of both at a certain ratio. Upon dissolution, the tracer 314 may float up to the surface where recorded properties of the wellbore environment can be downloaded by an inline detector that monitors fluid flow from the wellbore 300. An example of an inline detector may be an ICE Core® Fluid Analyzer from Halliburton. The dissolvable base material may include, but not limited to, a metal, alloy, polymer or a composite comprising any of the metal, alloy or polymer. Examples of such materials include, but not limited to, magnesium alloys and aluminum alloys, magnesium alloys and aluminum alloys doped with dopants such as nickel, copper, titanium, titanium, carbon, and gallium (to accelerate galvanic corrosion), calcium alloys, polyglycolic acid (PGA), polylactic acid (PLA), thiol, polyurethane, EPDM, nylon, polyvinyl alcohol (PVA), etc.

Figure 4:
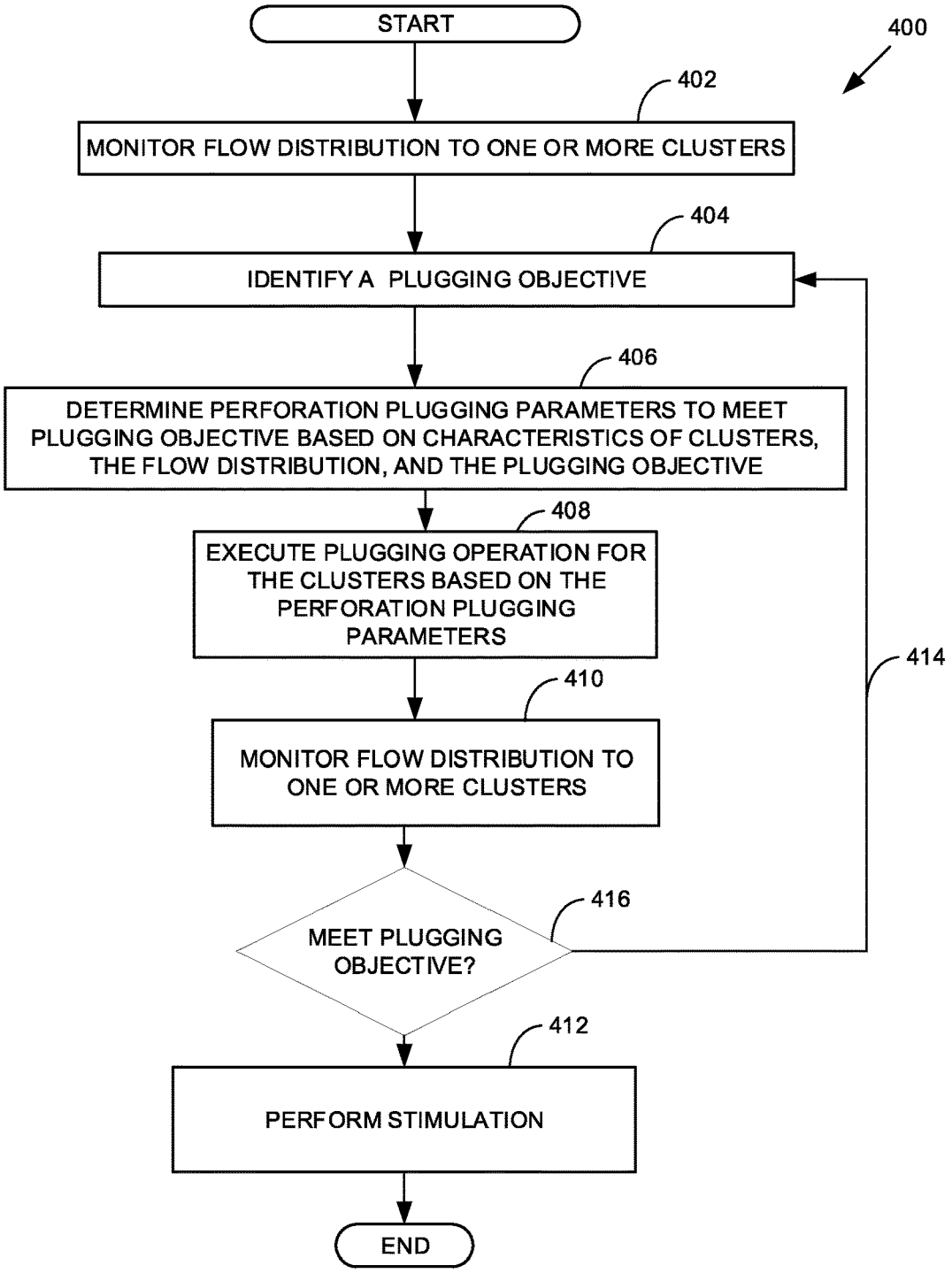
FIGS. 4 and 5 depict flowcharts associated with an illustrative process for perforation plug deployment.

FIG. 4 is a flowchart of an illustrative process 400 for real-time monitoring and control of perforation plug deployment to target plugging desired clusters of perforations in the zone. These functions may be performed by the injection control system, among other systems.

Briefly, at 402, a flow distribution of treatment fluid to one or more clusters in the wellbore may be monitored. At 404, a plugging objective may be determined. The plugging objective may be criteria associated with adjusting flow. For example, the criteria may be to reduce flow to the cluster and increase flow to other clusters, or vice versa. In some cases, the plugging objective may be a plurality of plugging objectives. At 406, parameters to achieve the plugging objective may be determined. At 408, a plugging operation may be executed. For example, perforation plugs may be dropped into the wellbore to meet the plugging objective. At 410, the flow distribution is monitored to one or more clusters. At 412, stimulation treatment continues if the plugging objective is met. At 414, if the plugging objective is not met, then the process may begin at 402 to again attempt to meet the plugging objective.

The flowcharts herein are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

Referring back, at 402, a flow distribution of treatment fluid to one or more clusters may be monitored. A zone of the wellbore being stimulated may have a plurality of clusters. Further, in some examples, one or both sides of the zone may be bounded by a well bore isolation device, such as a fracture plugs, so that treatment fluid injected into the wellbore flows within the zone. A top portion and a bottom portion of the zone may plugged with the well bore isolation device. The well bore isolation device could also be placed only at a bottom of the zone to isolate the zone from another zone further downhole when the treatment fluid is injected. Other variations are also possible.

One or more data sources may be used to estimate the flow distribution into each cluster in the wellbore. The flow distribution may be characterized in terms of flow into most, if not all, of the clusters of perforations, depending upon local stress changes or other characteristics of the surrounding formation that may impact the flow distribution. Another indicator of the downhole flow distribution may be the number of sufficiently stimulated clusters of perforations resulting from the fluid injection along the wellbore. A perforation cluster may be deemed sufficiently stimulated if, for example, the volume of fluid and proppant that it has received up to a point in the treatment stage has met a threshold. The threshold may be based on, for example, predetermined design specifications of the particular stimulation treatment. While the threshold can be described as a single value, it should be appreciated that embodiments are not intended to be limited thereto and that the threshold may be a range of values, e.g., from a minimum threshold value to a maximum threshold value.

The method used to monitor the flow distribution in real time may be dependent upon the types of measurements and diagnostics available. The following are a few examples of how the flow distribution can be monitored. It should be noted also that these methods can be used independently or combined together to monitor the flow distribution.

In one example, the injection control subsystem may monitor the flow distribution based on a qualitative analysis of real-time measurements of acoustic intensity or temporal heat collected by fiber-optic sensors disposed within the wellbore. Alternatively, the injection control subsystem may perform a quantitative analysis using the data received from the fiber-optic sensors. The quantitative analysis may involve, for example, assigning flow percentages to each cluster based on acoustic and/or thermal energy data accumulated for each cluster and then using the assigned flow percentages to calculate a corresponding coefficient representing variation of the fluid distribution across the clusters.

In another example, the injection control subsystem may monitor the flow spread and/or number of sufficiently stimulated clusters of perforations by performing a quantitative analysis of real-time micro-seismic data collected by downhole micro-seismic sensors, e.g., as included within the injections tools. The micro-seismic sensors may be, for example, geophones located in a nearby wellbore, which may be used to measure microseismic events within the surrounding subsurface formation along the path of the wellbore. The quantitative analysis may be based on, for example, a location and intensity of micro-seismic activity. Such activity may include different micro-seismic events that may affect fracture growth within the subsurface formation. In one or more embodiments, the length and height of a facture may be estimated based on upward and downward growth curves generated by the injection control subsystem using the micro-seismic data from the micro-seismic sensors. Such growth curves may in turn be used to estimate a surface area of the fracture. The surface area may then be used to compute the flow distribution.

In yet another example, the injection control subsystem may use real-time pressure measurements obtained from downhole and surface pressure sensors to perform real-time pressure diagnostics and analysis. The results of the analysis may then be used to determine the downhole flow distribution indicators, i.e., the flow spread and number of sufficiently stimulated clusters of perforations, as described above. The injection control subsystem in this example may perform an analysis of surface treating pressure as well as friction analysis, step down analysis, and/or other pressure diagnostic techniques to obtain a quantitative measure of the flow distribution.

In another example, the injection control subsystem may use real-time data from one or more tiltmeters to infer fracture geometry through fracture induced rock deformation during each stage of the stimulation treatment. The tiltmeters in this example may include surface tiltmeters, downhole tiltmeters, or a combination thereof. The measurements acquired by the tiltmeters may be used to perform a quantitative evaluation of the flow distribution.

It should be noted that the various analysis techniques in the examples above are provided for illustrative purposes only and that embodiments of the present disclosure are not intended to be limited thereto. It should also be noted that each of the above described analysis techniques may be used independently or combined with one or more other techniques. In some implementations, the analysis for monitoring the flow distribution may include applying real-time measurements obtained from one or more of the above-described sources to an auxiliary flow distribution model. For example, real-time measurements collected by the data source(s) during the stimulation treatment may be applied to a geomechanics model of the subsurface formation to simulate the flow distribution along the wellbore. The results of the simulation may then be used to determine a quantitative measure of the flow distribution and number of sufficiently stimulated clusters of perforations.

At 404, a plugging objective may be identified based on the flow distribution. The plugging objective may be criteria indicative of how the flow distribution is to be changed to adjust the flow distribution to the clusters to improve stimulation to certain clusters and reduce stimulation to other clusters. For example, if the treatment fluid flows relatively uniformly to each of a plurality of clusters, then each of the clusters may receive a similar but not equal amount of treatment fluid. In this case, the plugging objective might be to further balance the flow without completely shutting off any dusters during the stimulation treatment. As another example, if the flow distribution varies significantly among a plurality of dusters, then most of the treatment fluid may go to certain clusters. In this case, the plugging objective might be to shut off or plug certain clusters completely so that fluid flows to other clusters not receiving as much treatment fluid. Other examples of plugging objectives are also possible.

At 406, one or more plugging parameters or specifically perforation plugging parameters to meet the plugging objective may be determined based on characteristics of clusters, the flow distribution, and the plugging objective. Certain characteristics of each cluster of perforations in the zone may be known. For example, a location of a cluster of perforations may also be known based on the location where the perforation gun was positioned when fired to form the cluster. As another example, a perforation density and/or number of perforations in a cluster may be known. The perforation density and/or number of perforations may be known based on the known quantity of shaped charges fired to form the cluster. Additionally, or alternatively, the perforation density and/or number of perforations may be known based on an analysis of the flow distribution. For example, the step rate tests, pressure measurements, and/or a friction analysis may be indicative of the perforation density and/or number of perforations at a cluster. Further, models may be applied to the analysis of the flow distribution to determine the perforation density and/or number of perforations. As yet another example, a size of each perforation in a cluster may be known based on the size of the shaped charges used to form the cluster and a standoff from the casing. Other characteristics of the perforation and/or cluster may also be known.

The characteristics may be used to define perforation plugging parameters for the perforation plugs to plug perforations of a cluster in accordance with the plugging objective. The perforation plugging parameters may take a variety of forms. For example, the number of perforations and/or density of perforations in a cluster may be used to determine a plugging parameter of number of perforation plugs to drop. A number of perforation plugs approximately equal to or greater than the number of perforations may be dropped if the objective is to shut off flow to the cluster while less may be dropped if a cluster is not to be shut off completely. Additionally, or alternatively, the number to drop may be based on an estimate of density of perforation plugs which may reach the cluster based on the flow distribution. For example, the density of perforation plugs may be a number of perforation plugs per unit volume at the cluster. It is assumed that not all of the plugs may reach a cluster and a certain number of plugs may need to be dropped to achieve a certain density of perforation plugs to accomplish the desired plugging.

As another example, a shape of the perforation may dictate a plugging parameter of a shape of the perforation plug. A perforation plug may take a variety of shapes including spheres or footballs. Some perforations may be best plugged with a one shape versus another. As yet another example, the size of the perforation may dictate a plugging parameter of a size of the perforation plug. A plug equal to the perforation may be used to shut off a flow but anything less may reduce the flow but not shut it off. As another example, the size of the perforation may be related to a number of perforation plugs needed to shut off flow. For instance, if the perforation is larger and/or eroded, then more perforation plugs may be needed to shut off the flow. As yet another example, a location of the cluster may determine a plugging parameter of a plug material of the perforation plug. The plug material may be chosen to have a certain buoyancy to reach the cluster via the flow distribution in the wellbore.

In some embodiments, a plurality of perforations in a plurality of clusters may need to be plugged with the perforation plugs. As clusters of perforations are plugged, the flow distribution within the wellbore may change. For example, plugging of one cluster may affect the flow distribution to another cluster. As a result, a sequence of the dropping of the different perforation plugs may be defined so that a flow remains to plug desired cluster of perforations as other clusters are plugged. The perforation plugging parameters may be determined in view of this sequence. For example, the perforation plugging parameters may define a plurality of different types of perforation plugs which are to be dropped in sequence. Each type which is dropped may differ in shape, size, plug material etc. As an example, the plug material for certain perforation plugs may be chosen to have a certain buoyancy so that the perforation plugs reach the cluster in accordance with the flow distribution present when the perforation plugs are dropped.

In some embodiments, real-time modeling techniques may be used to determine the perforation plugging parameters. For example, a perforation plug data model may be used to estimate the plugging parameters for plugging a cluster of perforations. The perforation plug data model may be a linear or nonlinear model relating characteristics of the perforation, real time measurements, and the plugging objective to define the plugging parameters for the perforation plugs. The characteristics of the perforation may include one or more of a number of perforations in the cluster, density of perforations in the cluster, shape of the perforations, size of the perforations, and location of the perforations, among others. The real-time parameters may include, but are not limited to, a flow distribution within the subsurface formation. The plugging objective may indicate how the flow distribution is to be changed. In some implementations, the form of the model may be determined through any of various online machine learning techniques. Alternatively, the perforation plug data model may be a linear or nonlinear model generated from historical data acquired from previously completed wells in the hydrocarbon producing field.

The perforation plug data model used to determine the plugging parameters may be expressed by the following example model equation:

$$\text{Plugging Parameters}(1 \ldots N, 1 \ldots M) = \text{Model}(aA, bB, cC, dD, eE, fF, gG)$$

The model equation may be a function of one or more of characteristics of the perforation, of which the above is just an example. In the example model equation, the characteristics may include a number of perforations A in the cluster, density of perforations B in the cluster, shape of the perforations C, size of the perforations D, position of the perforations E in the wellbore (e.g., location, azimuth). The model may also be a function of a flow distribution F and a perforation plugging objective G. Coefficients a, b, c, d, e, f and g may be weighting factors which weigh the perforations A in the cluster, density of perforations B in the cluster, shape of the perforations C, size of the perforations D, location of the perforations E, flow distribution F, and perforation plugging objective G to define the plugging parameters which meet the perforation plugging objective. The coefficient may be a scalar or vector weighting determined during a training process It should be appreciated that the form and particular parameters input into the model equation may be adjusted as desired for a particular implementation. It should also be appreciated that other parameters, e.g., cluster spacing, perforations per cluster, cluster orientation, number of clusters, cluster position, zone location, and perforation formation scheme, etc., may be taken into consideration in addition to or in place of any of the aforementioned parameters.

For example, stress orientation may also be considered. There may be many stresses downhole. Stresses downhole may be simplified into vertical and horizontal stresses. Fractures may open against a minimum horizontal stress in a direction of maximum horizontal stress. So, depending on how a wellbore is drilled with respect to the horizontal stress, fractures may propagate along a wellbore or perpendicular to the wellbore. Generally, longitudinal fractures (e.g., along a wellbore) may be easier to initiate and propagate while transverse fractures (e.g., perpendicular to the wellbore) may be more difficult to initiate. Knowing the difficulty in fracturing in a certain direction may impact a number of plugs to drop to hold a pressure for diversion so as to stimulate fracturing in the certain directions. Further, knowing the difficulty in fracturing may impact a material for the plugs to drop to hold a pressure for diversion so as to stimulate fracturing in the certain direction. Other variations are also possible.

As another example, a density of the perforation plug may be defined based on at least one of a density of fluid in the subsurface formation, a location of entry points, and the flow distribution. In this case, the density referred to here may be of the perforation plug itself and based on the material which makes up the perforation plug. For instance, perforation plugs made of aluminum may have a greater density than perforation plugs made of a polymer. To illustrate, if the density of the fluid is lower than the density of the perforation plugs, then if the perforation plug misses a perforation, then the perforation plug may move further down into the wellbore and could plug a perforation below. As another illustration, if the density of the fluid is higher than the density of the perforation plugs, then if the perforation plug misses a perforation, then the perforation plug may float up in the wellbore and could plug a perforation above. The density of the perforation plug may be chosen based on a desired behavior of the perforation plug in the fluid.

The model equation may output the plugging parameters associated with perforation plugs. In the example model equation, the plugging parameters may be a two-dimensional matrix where each row indicates characteristics of a particular perforation plug.

It should also be appreciated that the example model equation may output parameters other than plugging parameters. For example, the example model equation may also output characteristics associated with fluid which is dropped along with the perforation plug. The characteristics may include density of the fluid, viscosity of the fluid, and/or velocity at which the fluid is injected. The fluid may enable the perforation plug to have a certain buoyancy and/or speed to control travel of the perforation plug to a cluster.

The perforation plug associated with the row may be dropped as a group to plug a certain cluster and the perforation plug associated with another row may be dropped as a group to plug another cluster. Further, plugs in an upper row of the matrix may be dropped before plugs further down in the matrix. The plugging parameters may be organized in other ways as well.

As will be described in further detail below, the perforation plug data model may also be calibrated or updated in real time based on whether the perforation plugging objective is met. For example, flow distribution obtained from one or more data sources after the perforation plugs are dropped may be compared to the perforation plugging objective. Any difference between the flow distribution and the perforation plugging objective that meets or exceeds a specified error tolerance threshold may be used to update the perforation plug data model. This allows the model's accuracy to be improved to achieve the perforation plugging objective as additional perforation plugs are injected. In one or more embodiments, the accuracy of the model may be improved by using only the data obtained during stimulation treatment of selected zones. The data obtained during other zones may be discarded. The discarded data may include, for example, outliers or measurements that are erroneous.

At 408, a plugging operation may be executed for the clusters based on the perforation plugging parameters. The execution may involve injecting perforation plugs meeting the perforation plug parameters determined at 406 into the wellbore. In the case that different types of perforation plugs are to be dropped, the different types of perforation plugs may be injected in a particular sequence to achieve the plugging objective. For example, less dense, more buoyant, perforation plugs may be dropped before more dense, less buoyant, perforation plugs. Alternatively, more dense perforation plugs may be dropped before less dense perforation plugs. Other variations are also possible.

In some cases, perforation plugs may be dropped with fluid of a certain density, viscosity, and/or velocity. The fluid may be chosen so that the perforation plug which is dropped has a desired buoyancy and travels at a desired rate to a cluster. Other variations are also possible.

At 410, the flow distribution to one or more clusters may be monitored to determine if the plugging objective has been met. The monitoring may involve several steps.

Figure 5:
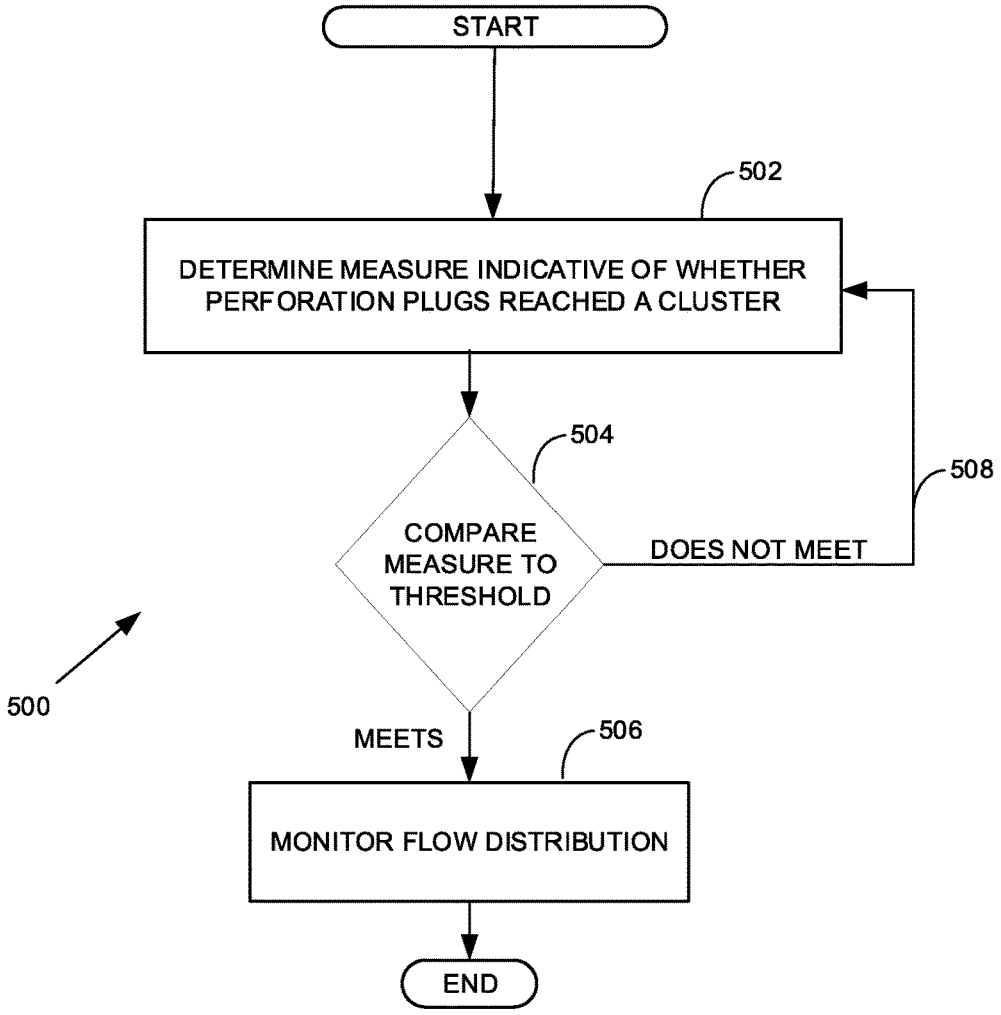

FIG. 5 illustrates this monitoring process 500 in more detail. At 502, the process 500 may first involve determining a measure indicative of whether perforation plugs reached a cluster. At 504, the measure may be compared to a threshold. If the measure meets the threshold, then at 506, flow distribution may be monitored to see if the perforation plug objective is met. If the measure does not meet the threshold, then at 508, the injection subsystem may wait for a period of time to pass and the determination may be performed again.

A sensor such a downhole listening device and/or surface listening device may be able to determine a measure indicative of whether perforation plugs reached a cluster. For example, fiber optics provides for distributed sensing, e.g., acoustic, pressure, light, NFC, RFID, and/or temperature, along a length of a fiber optics line positioned downhole. The sensor may take other forms as well.

In one example, the measure determined at 502 may be a count or estimate of a number perforation plugs which reached the cluster. The number of perforation plugs may be determined via an analysis of the signal emitted by each tracer of the perforation plug. Each signal emitted by each tracer may be unique. The unique signals sensed by a sensor such as an RFID or NFC sensor located at the cluster downhole at the cluster may be counted to determine the number of perforation plugs located at the cluster. At 504, the number may be compared to a threshold. If this number meets a threshold, then at 506, the flow distribution may be monitored for the cluster. If this number does not meet the threshold, then the flow distribution may not be monitored yet for the cluster. Instead, at 508, the injection subsystem may wait for a period of time to pass and the determination may be performed again. The period of time may allow for more perforation plugs to reach the cluster of perforations.

The threshold may take a variety of forms. For instance, the threshold may be a number based on a percentage of the number of perforation plugs that were dropped. The percentage may be an acceptable percentage of perforation plugs which reach the cluster to achieve the plugging objective. This process may be repeated for the one or more clusters in the stage.

In another example, the measure determined at 502 may be a strength of a signal. Each perforation plug may emit a signal. The signal may be emitted via a tracer embedded with the perforation plug. The signal may take a variety of forms.

In one example, the signal emitted by each perforation plug may be an acoustic signal. A tracer in the form of a transducer and electronic circuit may emit the acoustic signal. The acoustic signal may have a frequency and/or amplitude distinguishable from other sounds in the wellbore, such as a frequency and/or amplitude of fluid pumped in the wellbore. The signal from each perforation plugs may positively interfere with each other. A strength of the acoustic signals which positively interfere, e.g., acoustic intensity, may be measured at the cluster by a sensor such as an acoustic sensor located at the cluster downhole. A higher strength signal may indicate more perforation plugs at the cluster. A lower strength signal may indicate less perforation plugs at the cluster. At 504, the strength may be compared to a threshold. If this strength meets the threshold, then at 506, the flow distribution may be monitored. If this strength does not meet the threshold, the flow distribution may not yet be monitored for the cluster. Instead, at 508, the injection subsystem may wait for a period of time to pass so that more perforation plugs reach the cluster and the determination may be performed again.

In another example, the signal output by the perforation plugs may take the form of light. A tracer in the form of a light source, e.g., light emitting diode, and electronic circuit may emit the light. The principles described above would apply for the signal in the form of light. For example, light intensity would be measured by a sensor such as a photosensor located at the cluster downhole and compared to a threshold to determine whether the perforation plugs are at a cluster. Other variations are also possible including a perforation plug which emits both light and sound. The light and sound may be used to determine a position of the perforation plugs.

In yet another example, the signal emitted by each perforation plug may be a pressure signal. A tracer in the form of a pressure sensor and electronic circuit may emit the pressure signal. The pressure signal may indicate a certain pressure applied to the perforation plug indicative of the perforation plug being embedded in the perforation. The pressure signal from each perforation plug may constructively interfere. The pressure signal may be measured by a sensor such as a pressure sensor at the cluster. At 504, the pressure signal may be compared to a threshold. If the pressure signal meets a threshold, then a given number of perforation plugs may be embedded in the perforation. At 506, the flow distribution may be monitored for the cluster. If this number does not meet the threshold, then the flow distribution may not yet be monitored. Instead, at 508, the injection subsystem may wait for a period of time to pass and the determination may be performed again. The period of time may allow for more perforation plugs to be embedded into perforations in the cluster of perforations. This process may be repeated for the one or more clusters in the stage.

In another example, the signal emitted by each perforation plug may be based on one or more chemicals. The tracer of perforation plug may dissolve from the perforation plug when wedged into a perforation due to a reaction between the perforation plug and materials of the perforation. This may cause emission of one or more chemicals which may be detected by a downhole sensor sensitive to the one or more chemicals. A concentration or amount of detected one or more chemicals may be indicative of a number of perforation plugs embedded in the perforations.

In yet another example, the measure indicative of whether perforation plugs reached a cluster may include tracking a path of the perforation plug down the wellbore to the cluster. The path may be tracked via one or more sensors which measure the signals described above at different positions in the wellbore as it reaches a destination. When the perforation plug reaches a destination and plugs a perforation, the signals output by the perforation plug may stop and/or be attenuated, indicating that the perforation plug is wedged into a perforation.

In some examples, the tracer may have a sensor and memory for recording properties of the wellbore environment, such as pressure, temperature, fluid composition, and other environmental, physical, and chemical parameters as the perforation plugs travels in the wellbore 302. The properties may be periodically recorded as the perforation plug traveling in the wellbore. At some time, the tracer may dissolve from the perforation plug and float to the surface. In these examples, the recorded properties can be analyzed to identify the location of the perforation plug associated with the tracer and whether that location was at a cluster. The number of tracers which are located at the cluster at the cluster and/or traveled along a path to the cluster can be counted and compared to a threshold at 504. If this number meets the threshold, then at 506 the flow distribution may be monitored. If this number does not meet the threshold, then the flow distribution may not be monitored. Instead, the injection subsystem may wait for a period of time to pass and at 502 the determination may be performed again. The period of time may allow more perforation plugs to wedge into perforations in the cluster of perforations.

In some examples, one or more of the measures associated with a cluster may be compared to respective thresholds. If the one or more measures meets respective thresholds, the process may move to monitoring the flow distribution at 506. If the one or more measures does not meet respective thresholds, the process may wait for a period of time and follow path 502 where one or more measures indicative of whether perforation plugs reached a cluster is determined again. Further, the steps 502 and 504 may be repeated for one or more clusters in a zone such that when the measure associated with the one or more clusters meets the threshold, processing may continue to 506. Other variations are also possible.

Further, perforation plugs dropped to target a certain cluster may emit signals different from perforation plugs dropped to target another cluster. For example, certain perforation plugs may emit signals at a first amplitude and frequency while other perforation plugs may emit signals at a second amplitude and frequency. This way perforation plugs can be tracked with respect to the cluster it is intended reach.

The monitoring at 506 may involve estimating the flow distribution to each cluster. The flow distribution may be determined in a manner similar to that performed at block 402. Additionally, or alternatively, data collected by the tracers associated with the perforation plugs may be used to determine the flow distribution. For example, a flow distribution may be derived from which clusters the tracers reached. In another example, the signals received by the plurality of sensors along a path to a cluster may be indicative of the flow distribution. The signals from the tracers may be received at various positions in the subsurface formation over a period of time. The various position may be indicative of the flow in the subsurface formation and flow distribution to one or more clusters.

Referring back to FIG. 4, a determination 416 may be made if the flow distribution determined at 506 meets the plugging objective. For example, if the plugging objective was to shut off or plug certain clusters completely so that fluid flows to other clusters not receiving as much treatment fluid, then a determination may be made based on the monitoring of the flow distribution whether this objective was reached.

If the flow distribution is not met, then processing may return to 404 via 414 where new objectives may be determined and steps 406 to 410 repeated. The operations in blocks 404, 406, 408, 410, 414 may be repeated over one or more subsequent iterations until the flow distribution meets the objectives.

As another example, if the plugging objective was to balance the flow without completely shutting off any clusters during the stimulation treatment, then a determination may be made based on the monitoring of the flow distribution whether this objective was reached. If the flow distribution is not met, then processing may return to 404 where new objectives may be determined and steps 406 to 410 repeated. The operations in blocks 404, 406, 408, 410, 414 may be repeated over one or more subsequent iterations until the flow distribution meets the objectives.

Additionally, the perforation plugging data model may be updated based on a difference between the plugging objective and the flow distribution so that subsequent indications of plugging parameters are better estimated. The updating may include modifying the functional form of the perforation plug model, adding or deleting specific parameters represented by the model, and/or calibrating one or more of the model's parameter coefficients. The updated model is then used when processing returns back to 404.

For example, the sensor measurements based on the tracers may indicate not only a location of the perforation plug but also a density of that type of perforation plugs in that location. The density in this case may be a number of perforation plugs per unit volume, among other measures. A strength of signals from tracers that constructively interfere may be proportional to the density of the perforation plugs. For example, a stronger signal may indicate a greater density of perforation plugs while a weaker signal may indicate a lesser density of perforation plugs. This information may be used to assess whether sufficient perforation plugs are reaching a particular location downhole to meet the perforation plugging objective. The location may be at a cluster or along a path to a cluster. The perforation plugging objective may indicate a density of perforation plugs to reach a location. If the density at the location is less than the density indicted by the perforation plugging objective, then additional perforation plugs may be dropped to increase the density of perforation plugs that reach that location. If the density at the location is more than the density indicated by the perforation plugging objective, additional perforation plugs may not be dropped to decrease the density of perforation plugs that reach that location to save on perforation plugs. Other arrangements are also possible.

The flowchart of FIG. 4 and FIG. 5 describes the plugging objective as indicating how to adjust the flow distribution to a plurality of clusters to improve stimulation to certain clusters and reduce stimulation to other clusters. In other examples, the plugging objective may be to adjust the flow distribution to a single cluster or even a number of perforations in that single cluster. In this regard, the steps of FIG. 4 and FIG. may involve plugging perforations associated with the single cluster. The steps of FIG. 4 and FIG. 5 may then be repeated for another cluster. Other variations are also possible.

If the flow distribution is met, then stimulation treatment may be performed at 412.

Figure 6:
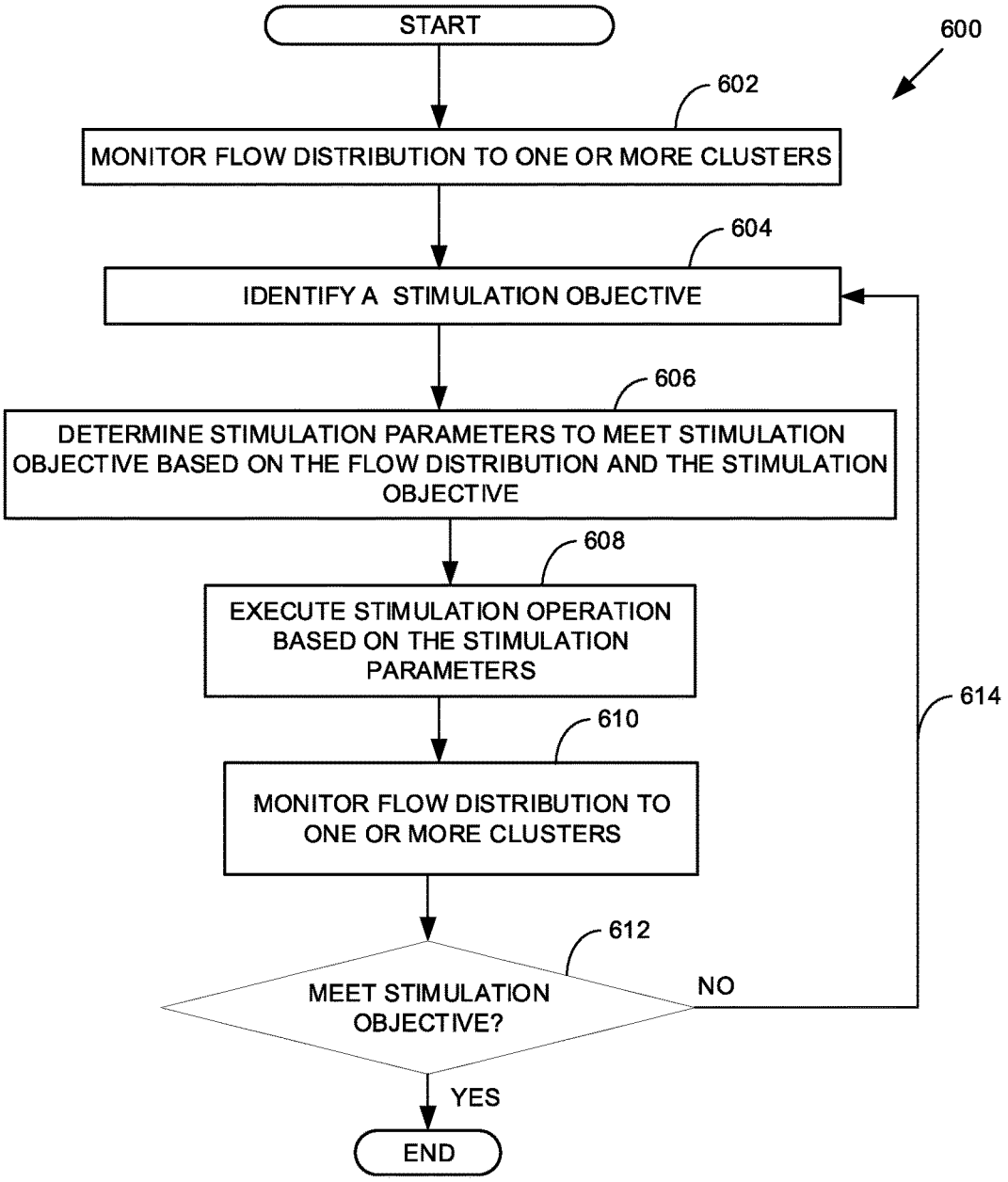
FIG. 6 depicts a flowchart associated with an illustrative process for stimulation of the subsurface formation.

FIG. 6 is a flowchart of an example process 600 for stimulating the subsurface formation. The process 600 may be performed as part of the stimulation process identified at 412 after the perforation plugging process. However, the process 600 is not so limited. In other examples, the process 600 may be performed before a perforation plugging process, during the perforation plugging process instead of after the perforation plugging operation as shown in FIG. 4, and/or before an earlier stimulation process, among other variations.

Briefly, at 602, a flow distribution of treatment fluid to one or more clusters in the wellbore may be monitored. At 604, a stimulation objective may be determined. The stimulation objective may be criteria associated with adjusting flow of the treatment fluid in the subsurface formation. For example, the criteria may be to increase or decrease flow to a cluster to increase or decrease fracturing of the subsurface formation at the cluster. At 606, stimulation parameters may be determined to achieve the stimulation objective. At 608, a stimulation operation may be executed. For example, treatment fluid having a certain concentration of stimulation additives may be injected into the wellbore. At 610, the flow distribution is monitored to one or more clusters. At 612, stimulation treatment stops if the stimulation objective is met. At 614, stimulation treatment continues if the stimulation objective is not met. Process 600 may be performed by the injection control system, among other systems.

The flowchart is provided to aid in understanding the illustrations and are not to be used to limit scope of the claims. The flowchart depicts example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

Referring back, at 602, a flow distribution of treatment fluid to one or more clusters may be monitored. In one example, the flow distribution at 602 may be determined based on the flow distribution determined at 410. For instance, the monitoring at 402 may involve receiving an indication of the flow distribution determined at 410. In another example, the flow distribution at 602 may be determined in real time or as part of an earlier stimulation.

The method used to monitor the flow distribution in real time may be dependent upon types of measurements and diagnostics available. For example, the methods may include those described at 402 above including DAS and DTS measurements. Also, pressure signals from the sensors may be indicative of the flow distribution. The pressure signals may indicate whether the fluid is flowing into fractures. If the pressure signals in an area are increasing when the treatment fluid is injected into the subsurface formation, then this may mean that the fluid is not flowing into fractures while if the pressure signals in the area are decreasing or remains the same when the treatment fluid is injected into the subsurface formation, then this may mean that the fluid is flowing into fractures. As another example, the methods may be based on the tracers associated with perforation plugs dropped in the wellbore. The methods may include determining whether the perforation plug reached a duster based on strength of signals emitted by tracers and/or following a path of a perforation plug downhole. For example, fiber optics provides for distributed sensing, e.g., acoustic, pressure, light, NFC, RFID, and/or temperature, of signals emitted by tracers associated with the perforation plugs along a length of a fiber optics line positioned downhole. The sensing at various locations, e.g., points, in the subsurface formation may be indicative of a path of the perforation plug downhole to a cluster and flow distribution. Additionally, or alternatively, a path of a perforation plug downhole may be chemical-based as a result of the tracer emitting a chemical which is detected at various points over a period of time. Again, the sensing at various points in the subsurface formation over the period of time may be indicative of a path of the perforation plug to a cluster and flow distribution.

The flow distribution may indicate characteristics of the subsurface formation. For example, the flow distribution may indicate a number of perforation and/or clusters are open and taking fluid. The flow distribution may also indicate which perforations and/or clusters the treatment fluid is flowing to. As another example, the flow distribution may be indicative of friction pressure. Fluid may be incident to the wellbore at a fracture initiation angle. A preferred fracture initiation angle may be a preferred angle for which a fracture is to be initiated and/or grown in the wellbore. This angle may be reflected in the wellbore. For example, the preferred angle may be the angle between a perforation and a fracture in the wellbore. If an angle between the fracture initiation angle and the preferred fracture initiation angle are not aligned, then there may be resistance in the fluid flow from the perforation to the fracture and a high friction pressure. If the angle between the fracture initiation and the preferred fracture initiation angle are aligned, then there may be less resistance in the fluid flow from the perforation to the fracture and a low friction pressure. In this regard, the friction pressure may be indicative of a fracture initiation angle with respect to the wellbore. The flow distribution may indicate other characteristics of the subsurface formation as well.

At 604, a stimulation objective may be identified. The stimulation objective may be criteria indicative of how the flow distribution is to be changed to adjust the flow distribution to the clusters to improve stimulation to certain clusters and reduce stimulation to other clusters.

Figure 7:
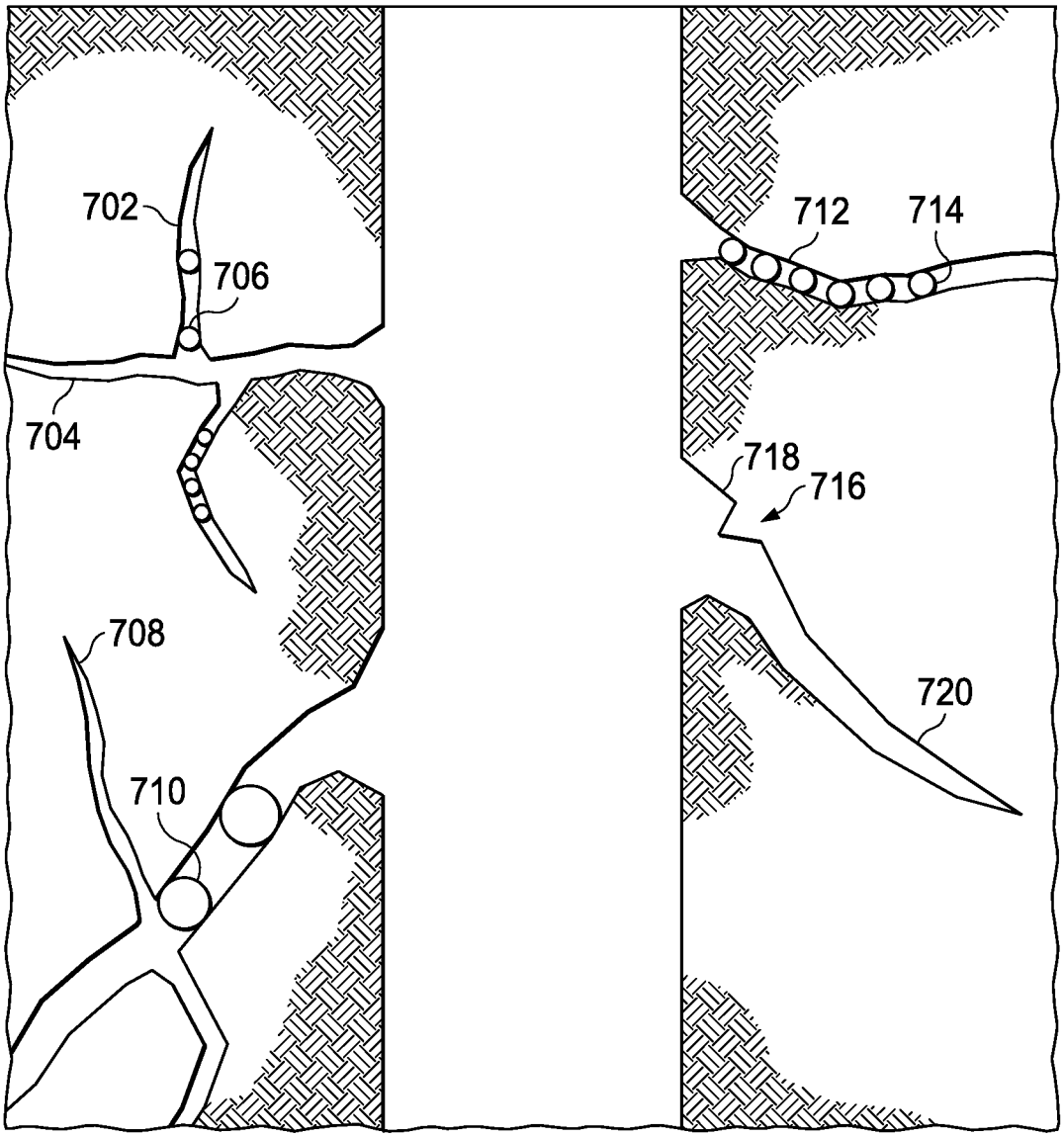
FIG. 7 is an example schematic view of various stimulation objectives.

FIG. 7 is an example schematic view of various stimulation objectives in accordance with stimulation of a subsurface formation. The stimulation objective may be based on the flow distribution. For example, if the treatment fluid flows relatively uniformly to each of a plurality of clusters and has a uniform pressure distribution, then each a the clusters may receive a similar but not equal amount of treatment fluid. In this case, the stimulation objective might be to prop microfractures 702 of the created fractures 704. The propping is shown as using stimulation additives 706 which flow into the microfractures 702 but do not plug the microfractures 702 allowing production of hydrocarbons.

As another example, if the flow distribution varies significantly among a plurality of clusters and does not have a uniform pressure distribution, then most of the treatment fluid may go to certain clusters. In this case, the stimulation objective might be to increase fracturing of other certain clusters so that the flow distribution of the treatment fluid is more uniform. The fracturing is shown by using stimulation additives 710 which are forced into the perforations at high pressure to form the fracture 708. Additionally, or alternatively, the stimulation objective might be to reduce or shut off a flow to certain clusters. Shutting off the flow to certain clusters may be achieved by causing stimulation additives 710 to enter the fracture 712 in high concentrations such that the flow to the fracture is plugged rather than propped. Still additionally, or alternatively, the stimulation objective might be to adjust fluid flow to fracture 714 to prop the fracture 712 (hold it open after the treatment stops) and/or control flow of fluid into fracture 708. Additionally, or alternatively, the stimulation objective might be to direct fluid flow down fracture 708 to create more secondary fractures (or even tertiary fractures), and/or keep extending fracture 708 by plugging fractures 708 with stimulation additives. Other variations are also possible.

As another example; if the friction pressure is high at certain clusters, then the stimulation objective may be to reduce the friction pressure to those clusters. Stimulation additives capable of breaking down the subsurface formation at 716 which serves to restrict flow between the perforation 718 and fracture 720 may be flowed to the perforation and/or duster. The stimulation objective may take other forms as well.

Referring back, at 606, one or more stimulation parameters to meet the stimulation objective may be determined based on the flow distribution and the stimulation objective. The stimulation parameters may take a variety of forms. The stimulation parameters may define the hydraulic fluid. The stimulation parameters may identify a volume of hydraulic fluid to meet the stimulation objective. As another example, the stimulation parameter may include a type of the hydraulic fluid to meet the stimulation objective. As yet another example, the stimulation parameter may include an amount of stimulation additives to mix with the hydraulic fluid to achieve a certain concentration of the stimulation additives in the treatment fluid. As another example, the stimulation parameter may include a size of the stimulation additive. Other variations are also possible.

The stimulation additives may serve various functions, including propping fractures, controlling leakoff, adjusting friction pressure, initiating fractures etc. To illustrate how the stimulation additives would affect flow distribution, consider the following examples.

If the stimulation objective is to prop microfractures, then the stimulation parameters may identify a stimulation additive which is an ultrafine particulate. The ultrafine particulate may take a variety of sizes but typically may be less than 100 mesh (149 microns) and specifically 3-5 microns and/or 20-25 microns. Further, the treatment fluid may have a given concentration of the stimulation additive such as 0.05 to 3 pounds per gallon (ppg). The concentration may be chosen so that individual proppants do not bridge together to block the flow of the treatment fluid in the microfractures.

If the stimulation objective is to reduce friction pressure or form new fractures, the stimulation parameters may include using a stimulation additive which is 20-25 microns, for example, to breakdown the wellbore.

If the stimulation objective is to block fluid flow to certain fractures, the stimulation parameters may include a high amount of the stimulation additives mixed in the hydraulic fluid to form a high concentration of stimulation additive. The high concentration of stimulation additive would bridge together in fractures blocking fluid flow in the fracture. Other variations are also possible.

In some embodiments, a plurality of different types of stimulation additives may be dropped during the stimulation treatment. The types may be dropped in a particular sequence. For example, if the stimulation objective is to initiate new fractures, large particulates, e.g., 20-25 microns, may be first dropped to help breakdown, form microfractures, and/or control leakoff and then small particulates, e.g., 3-5 microns, may be dropped to prop smaller microfractures, and the large particulates, e.g., 20-25 microns, may be dropped to prop larger microfractures. The stimulation parameters may indicate the sequence of the dropping.

In some embodiments, the small and large particulates may be less than 150 microns, and where small particulates are at least half of the size of the large particulates. Further, the large particulates may be 20 to 50 microns and the small particulates may be 0.1 to 10 microns.

In some embodiments, a number of perforations and size in a cluster may be used to determine an amount of stimulation additive to use. For example, if the stimulation objective is to block the perforations, then the number of perforations will define an amount of stimulation additives to use so that enough stimulation additive is present in the treatment fluid to block the perforation. Similarly, a size of the perforations will define a size of the stimulation additive which is large enough to block the fluid flow when embedded in the perforation. For example, if the stimulation objective is to reduce flow to the perforations, then the number of perforations will define an amount of stimulation additives to use so that enough stimulation additive is present to reduce flow to the perforation by bridging together in a fracture. Similarly, the size of the perforations will define a size of the stimulation additive which is large enough to reduce flow but not block the fluid flow when embedded in the perforation. In this regard, the stimulation parameters may be based on formation characteristics.

In some embodiments, real-time modeling techniques may be used to determine the stimulation parameters. For example, a stimulation data model may be used to estimate the stimulation parameters for stimulation. The stimulation data model may be a linear or nonlinear model relating real time measurements of the flow distribution, formation characteristics, and/or the stimulation objective to define the stimulation parameters for the subsurface formation. The real-time parameters may include, but are not limited to, a flow distribution within the subsurface formation. The formation characteristics may describe the clusters and perforations of the clusters. The stimulation objective may indicate how the flow distribution to one or more clusters is to change. In some implementations, the form of the model may be determined through any of various online machine learning techniques. Alternatively, the stimulation data model may be a linear or nonlinear model generated from historical data acquired from previously completed wells in the hydrocarbon producing field.

The stimulation data model used to determine the stimulation parameters may be expressed by the following example model equation:

$$\text{Stimulation Parameters}(1 \ldots N, 1 \ldots M) = \text{Model}(aA, bB, cC, dD, eE)$$

The model equation may be a function of various inputs including a flow distribution A of the zone of the subsurface formation and a stimulation plugging objective B. The model may also be a function of a friction pressure C, pressure D, and formation characteristics E in the subsurface formation. Coefficients a, b, c, d, and e may be weighting factors which weigh the flow distribution A, stimulation plugging objective B, friction pressure C, pressure D, and formation characteristics E to define the stimulation parameters which meet the stimulation objective. The coefficient may be a scalar or vector weighting determined during a training process.

It should be appreciated that the form and particular parameters input into the model equation may be adjusted as desired for a particular implementation. It should also be appreciated that other parameters, e.g., cluster spacing, perforations per cluster, cluster orientation, number of clusters, cluster position, zone location, and perforation formation scheme, etc., may be taken into consideration in addition to or in place of any of the aforementioned parameters.

The model equation may output the stimulation parameters associated with stimulation process. In the example model equation, the stimulation parameters may be a two-dimensional matrix where each row indicates characteristics of the treatment fluid to be used in the stimulation of the formation, such as a volume of hydraulic fluid, amount of stimulation additive, size of stimulation additive, etc. The treatment fluid associated with a first row may be injected and the treatment fluid associated with a second row may be injected after the treatment fluid in the first row is injected to achieve a desired stimulation. The treatment fluid associated with the second row may be injected after a period of time sufficient such that fracturing by the treatment fluid associated with the first row is complete and the flow distribution changes. The stimulation parameters may be organized in other ways as well.

As will be described in further detail below, the stimulation data model may also be calibrated or updated in real time based on whether the stimulation objective is met. For example, flow distribution obtained from one or more data sources after the stimulation treatment may be compared to the stimulation objective. Any difference between the flow distribution and the stimulation objective that meets or exceeds a specified error tolerance threshold may be used to update the stimulation data model. This allows the model's accuracy to be improved to achieve the stimulation objective as stimulation treatment continues. In one or more embodiments, the accuracy of the model may be improved by using only the data obtained during stimulation treatment of selected zones. The data obtained during other zones may be discarded. The discarded data may include, for example, outliers or measurements that are erroneous.

At 608, a stimulation operation may be executed based on the stimulation parameters. The execution may involve injecting treatment fluid meeting the stimulation parameters determined at 606 into the wellbore, such as type of hydraulic fluid, volume of the hydraulic fluid, amount, type and size of stimulation additives etc. The injection may be performed by the injection system 214. In the case that different stimulation additives are to be delivered, the treatment fluid with the different stimulation additives may be injected in a particular sequence to achieve the stimulation objective. The stimulation additives may be pumped in dry form or mixed with fluid such as hydraulic fluid, conventional proppant such as 20/40 or 40/70 mesh sand, or polymers. Other variations are also possible.

At 610, the flow distribution to the one or more clusters is monitored. The flow distribution may be monitored in many ways. In one example, a sensor may provide an indication of the flow distribution. In some cases, the flow distribution may be indirectly monitored by a pressure measurement in the subsurface formation. The sensors may take various forms including the fiber optics which provides for distributed sensing, e.g., acoustic, pressure, and/or temperature, along a length of a fiber optics line positioned downhole, to determine the flow distribution and/or pressure measurement. The fiber optics may also detect the signals from the tracers associated with the perforation plugs in the subsurface formation indicative of the flow distribution to a cluster and/or a stage of the wellbore.

At 612, the flow distribution may be compared to a threshold. The threshold may be associated with the stimulation objective. While the threshold can be described as a single value, it should be appreciated that embodiments are not intended to be limited thereto and that the threshold may be a range of values, e.g., from a minimum threshold value to a maximum threshold value.

For example, if the stimulation objective is to increase flow, the threshold may be a flow which indicates the cluster is accepting sufficient fluid. If the flow distribution meets the threshold at 612, then the stimulation treatment may end for that zone since the stimulation objective is met and another zone may be stimulated. The friction pressure may have been reduced, fractures increased, and/or microfractures propped to meet the stimulation objectives. If the flow distribution does not meet the threshold at 612, then the stimulation treatment may continue at 614 since the stimulation objective is not met and processing may continue to 604 where new stimulation objectives may be determined and steps 606 to 612 repeated. The operations in blocks 604, 606, 608, 610, 612 may be repeated over one or more subsequent iterations until the flow distribution meets the stimulation objectives.

As another example, if the stimulation objective is to reduce flow, the threshold may be a flow which indicates the cluster is accepting less fluid. If the flow distribution meets the threshold at 612, then the stimulation treatment may end for that zone since the stimulation objective is met and another zone may be stimulated. The fractures may be blocked or plugged with the stimulation additive to reduce the flow. If the flow distribution does not meet the threshold at 612, then the stimulation treatment may continue at 614 since the stimulation objective is not met and processing may continue to 604 where new stimulation objectives may be determined and steps 606 to 612 repeated. The operations in blocks 604, 606, 608, 610, 612 may be repeated over one or more subsequent iterations until the flow distribution meets the stimulation objectives.

As yet another example, if the stimulation objective is to reduce flow, the threshold may be a pressure measurement. If the pressure measurement meets the threshold at 612, then the stimulation treatment may end for that zone since the stimulation objective is met and another zone may be stimulated. The pressure may indicate that the fluid flow in the fracture is inhibited resulting in less fluid flow to meet the stimulation objectives. If the flow distribution does not meet the threshold at 612, then the stimulation treatment may continue at 614 since the stimulation objective is not met and processing may continue to 604 where new stimulation objectives may be determined and steps 606 to 612 repeated. The operations in blocks 604, 606, 608, 610, 612 may be repeated over one or more subsequent iterations until the flow distribution meets the stimulation objectives.

As another example, if the flow distribution meets the threshold at 612, then the stimulation treatment may not stop. Stimulation may continue until other stimulation objectives are met. Other variations are also possible.

Example Computer

Figure 8:
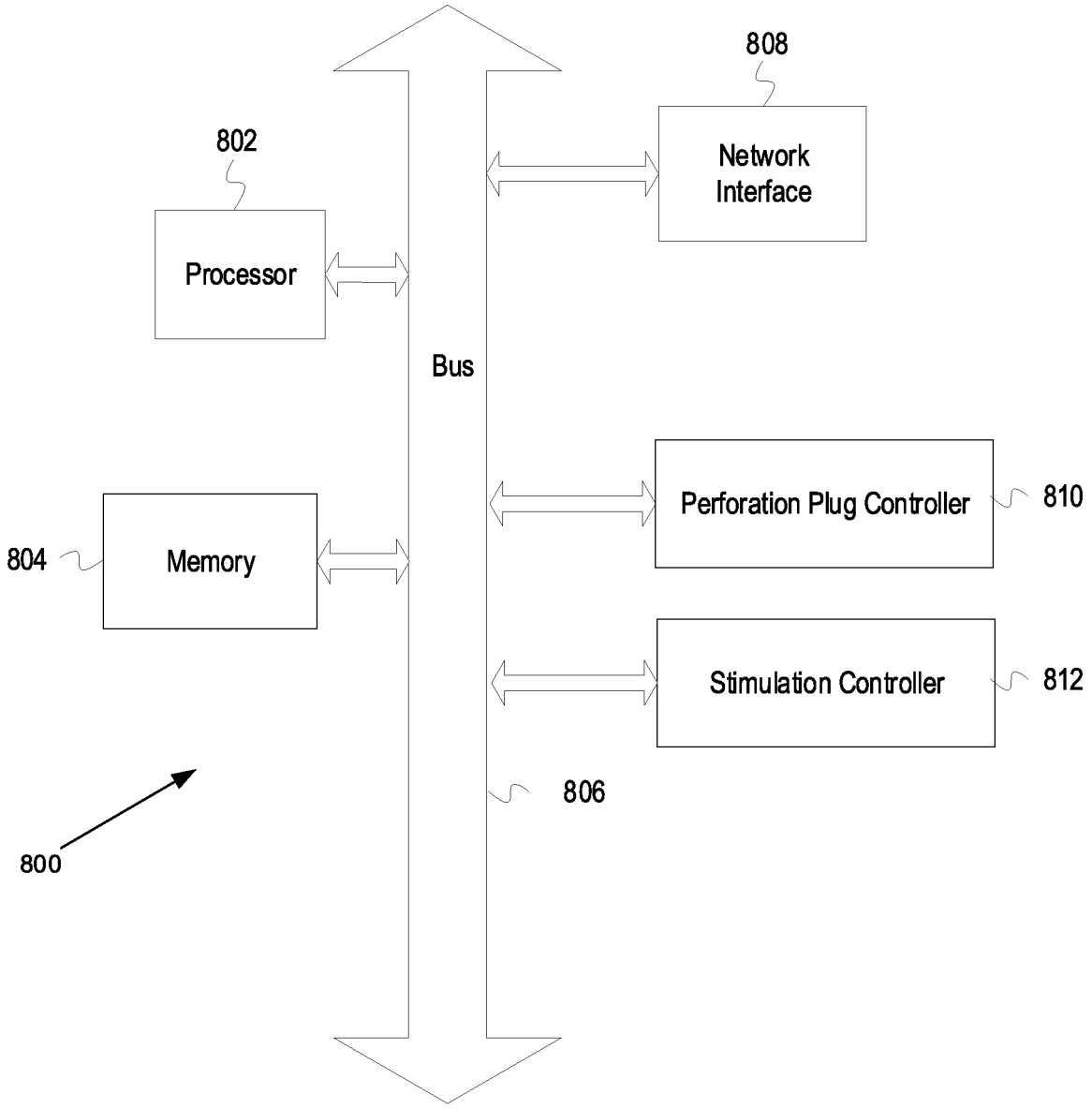
FIG. 8 depicts an example computer according to some embodiments.

FIG. 8 depicts an example computer 800 for performing the functions of FIG. 4-6, according to some embodiments. The computer includes a processor 802 (possibly including multiple processors, multiple cores, multiple nodes, and/or implementing multi-threading, etc.). The computer includes memory 804. The memory 904 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 606 (e.g., PCI, ISA, PCI-Express, HyperTransport® bus, InfiniBand® bus, NuBus, etc.) and a network interface 808 (e.g., a Fiber Channel interface, an Ethernet interface, an internet small computer system interface, SONET interface, wireless interface, etc.).

The computer also includes a perforation plug controller 810 and stimulation controller 812. The perforation plug controller 810 can perform one or more operations for real-time monitoring and control of perforation plug deployment (as described above) in stimulation of the formation. The stimulation controller 812 can perform one or more operations for real-time monitoring and control of treatment fluid deployment (as described above) in stimulation of the formation. In some cases, the perforation plug controller 810 and the stimulation controller 812 may be integrated into a single controller.

Any one of the previously described functionalities may be partially (or entirely) implemented in hardware and/or on the processor 802. For example, the functionality may be implemented with an application specific integrated circuit, in logic implemented in the processor 802, in a co-processor on a peripheral device or card, etc. Further, realizations may include fewer or additional components not illustrated in FIG. 8 (e.g., video cards, audio cards, additional network interfaces, peripheral devices, etc.). The processor 802 and the network interface 808 are coupled to the bus 806. Although illustrated as being coupled to the bus 806, the memory 804 may be coupled to the processor 802.

It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method, or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any non-transitory tangible medium that can contain, or store a program for use by or in connection with an instruction execution system, apparatus, or device. A machine-readable storage medium is not a machine-readable signal medium.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for real-time monitoring and control of perforation plug deployment as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Additional embodiments can include varying combinations of features or elements from the example embodiments described above. For example, one embodiment may include elements from three of the example embodiments while another embodiment includes elements from five of the example embodiments described above.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: A method comprising: monitoring a flow distribution to one or more entry points into a subsurface formation; identifying plugging criteria based on a flow distribution; determining characteristics associated with plugs to be dropped into a wellbore associated with the subsurface formation based on the flow distribution, characteristics of the one or more entry points, and the plugging criteria; causing the plugs to be dropped into the wellbore, wherein the plugs have tracers; and detecting based on the tracers whether the plugs reached a location associated with the one or more entry points.

Embodiment 2: The method of Embodiment 1, further comprising: based on the perforation plugs reaching the location, monitoring a new flow distribution to the one or more entry points; determining whether the new flow distribution meets the plugging objective; based on the new flow distribution meeting the plugging objective, continuing the stimulation treatment; and based on the new flow distribution not meeting the plugging objective, adjusting the new flow distribution.

Embodiment 3: The method of Embodiment 1 or 2, wherein the one or more entry points comprises one or more clusters of perforations; and wherein determining characteristics associated with plugs to be dropped into the wellbore comprises inputting at least one of a number of perforations in the one or more clusters, a density of perforations in the one or more clusters, a size of the perforations in the one or more clusters, a shape of the perforations in the one or more clusters, the flow distribution to the one or more clusters, and the performance plugging objective into a model which outputs the characteristics associated with the perforation plugs to be dropped into the wellbore, wherein the characteristics comprise a size of the perforation plugs.

Embodiment 4: The method of any of Embodiments 1-3, wherein a density of the plugs is based on a density of fluid in the subsurface formation, a location of entry points, and the flow distribution.

Embodiment 5: The method of any of Embodiments 1-4, wherein detecting based on the tracers comprises measuring a strength of acoustic signals from the plugs; and determining that the plugs reached the one or more entry points based on the strength exceeding the threshold.

Embodiment 6: The method of any of Embodiments 1-5, The method of claim 1, wherein detecting based on the tracers comprises receiving via a sensor disposed at the one or more entry points unique signals from plugs; counting a number of the unique signals; and determining whether the count exceeds a threshold.

Embodiment 7: The method of any of Embodiments 1-6, wherein the unique signals are output by at least one of a Radio Frequency Identification (RFID) and a Near Field Communication (NFC) associated with the tracers.

Embodiment 8: The method of any of Embodiments 1-7, wherein plugs comprise first plugs of a first buoyancy and second plugs of a second buoyancy dropped from a surface or downhole, and wherein dropping the plugs comprises dropping the first plugs with the first buoyancy and then dropping the second plugs with the second buoyancy.

Embodiment 9: The method of any of Embodiments 1-8, wherein detecting based on the tracers comprises receiving a pressure signal from the plugs indicative of the plugs being wedged into the one or more entry points.

Embodiment 10: The method of any of Embodiments 1-9, wherein the tracers are electronic chips embedded in the perforation plugs.

Embodiment 11: One or more non-transitory computer readable media comprising program code, the program code to: monitor a flow distribution to one or more entry points into a subsurface formation; identify plugging criteria based on the flow distribution; determine characteristics associated with plugs to be dropped into a wellbore associated with the subsurface formation based on the flow distribution, characteristics of the one or more entry points, and the plugging criteria; cause the plugs to be dropped into the wellbore, wherein the plugs have tracers; and detecting based on the tracers whether the plugs reached a location associated with the one or more entry points, wherein the characteristics comprise a size of the perforation plugs.

Embodiment 12: The one or more non-transitory computer readable media of Embodiment 11, wherein the one or more entry points comprises one or more clusters of perforations; and wherein the program code to determine characteristics associated with plugs to be dropped into the wellbore comprises program code to input at least one of a number of perforations in the one or more clusters, a density of perforations in the one or more clusters, a size of the perforations in the one or more clusters, a shape of the perforations in the one or more clusters, the flow distribution to the one or more clusters, and the performance plugging objective into a model which outputs the characteristics associated with the perforation plugs to be dropped into the wellbore.

Embodiment 13: The one or more non-transitory computer readable media of Embodiments 11 or 12, wherein the one or more entry points comprises one or more clusters of perforations.

Embodiment 14: The one or more non-transitory computer readable media of any of Embodiments 11-13, wherein the program code to detect based on the tracers comprises program code to measure a strength of acoustic signals from the plugs; and determine that the plugs reached the one or more entry points based on the strength exceeding the threshold.

Embodiment 15: The one or more non-transitory computer readable media of any of Embodiments 11-14, wherein the program code to detect based on the tracer comprises program code to receive via a sensor disposed at the one or more entry points unique signals from plugs; and count a number of the unique signals; and determining whether the count exceeds a threshold.

Embodiment 16: The one or more non-transitory computer readable media of any of Embodiments 11-15, wherein the unique signals are output by at least one of a Radio Frequency Identification (RFID) and a Near Field Communication (NFC) associated with the tracers.

Embodiment 17: The one or more non-transitory computer readable media of any of Embodiments 11-16, wherein the plugs comprise first plugs of a first buoyancy and second plugs of a second buoyancy dropped from a surface or downhole, and wherein dropping the perforation plugs into the wellbore comprises dropping the first plugs with the first buoyancy and then dropping the second plugs with the second buoyancy.

Embodiment 18: The one or more non-transitory computer readable media of any of Embodiments 11-17, wherein the tracers are electronic chips embedded in the plugs.

Embodiment 19: A system comprising: a sensor; a processor; and a machine readable medium having program code executable by the processor to cause the processor to: monitor, by the sensor, a flow distribution to one or more entry points into a subsurface formation; identify plugging criteria based on the flow distribution; determine characteristics associated with plugs to be dropped into a wellbore associated with the subsurface formation based on the flow distribution, characteristics of the one or more entry points, and the plugging criteria; cause the plugs to be dropped into the wellbore, wherein the plugs have tracers; and detect, by the sensor, based on the tracers whether the plugs reached a location associated with the one or more entry points.

Embodiment 20: The system of Embodiment 19, wherein the sensor is one or more of a downhole listening device, a surface listening device, or an inline detector for sensing signals associated with the tracers.

Embodiment 21: A method comprising: monitoring a first flow distribution to one or more entry points into a subsurface formation; identifying stimulation criteria based on the first flow distribution; determining at least one characteristic associated with a first treatment fluid to be injected into a wellbore associated with the subsurface formation based on the first flow distribution, wherein the first treatment fluid meets the stimulation criteria; stimulating the subsurface formation with the first treatment fluid; monitoring a second flow distribution based on the stimulation; determining whether the second flow distribution meets the stimulation criteria; and stimulating the subsurface formation with a second treatment fluid based on the determination that the second flow distribution does not meet the stimulation criteria.

Embodiment 22: The method of Embodiment 21, wherein monitoring a first flow distribution to one or more entry points into the subsurface formation comprises detecting signals from one or more tracers associated with perforation plugs flowing in the subsurface formation at various locations in the subsurface formation.

Embodiment 23: The method of Embodiment 21 or Embodiment 22, wherein the one or more tracers are electronic chips embedded in the perforation plugs.

Embodiment 24: The method of any of Embodiments 21-23, wherein the signals are at least one of a Radio Frequency Identification (RFID) and a Near Field Communication (NFC) associated with the one or more tracers.

Embodiment 25: The method of any of Embodiments 21-24, wherein the at least one characteristic associated with the first treatment fluid comprises at least one of a size of a stimulation additive in the first treatment fluid, a concentration of the stimulation additive in the first treatment fluid, and a type of the stimulation additive in the first treatment fluid.

Embodiment 26: The method of any of Embodiments 21-25, wherein the one or more entry points comprises one or more clusters of perforations.

Embodiment 27: The method of any of Embodiments 21-26, further comprising monitoring a pressure signal in the subsurface formation and wherein determining the at least one characteristic associated with the first treatment fluid to be injected into the wellbore based on the first flow distribution to meet the stimulation criteria comprises determining the at least one characteristic associated with the first treatment fluid to be injected into the wellbore based on the pressure signal.

Embodiment 28: The method of any of Embodiments 21-27, wherein monitoring the pressure signal in the subsurface formation comprises detecting the pressure signal from one or more tracers associated with perforation plugs flowing in the subsurface formation at various locations in the subsurface formation.

Embodiment 29: The method of any of Embodiments 21-28 wherein the first treatment fluid has a stimulation additive of a first size and the second treatment fluid has a stimulation additive of a second size, and wherein stimulating the subsurface formation with the first treatment fluid comprises stimulating the subsurface formation with the first treatment fluid to form microfractures and stimulating the subsurface formation with the second treatment fluid to prop, control leakoff, reduce friction pressure, or initiate fractures.

Embodiment 30: The method of any of Embodiments 21-29, wherein the first size and second size are less than 150 microns, and wherein second size is at least half of the first size.

Embodiment 31: The method of any of Embodiments 21-30, wherein the first size is 20 to 50 microns and the second size is 0.1 to 10 microns with a concentration of the first size and second size of 0.05 to 3 pounds per gallon.

Embodiment 32: One or more non-transitory machine readable media comprising program code, the program code to: monitor a first flow distribution to one or more entry points into a subsurface formation; identify stimulation criteria based on the first flow distribution; determine at least one characteristic associated with a first treatment fluid to be injected into a wellbore associated with the subsurface formation based on the first flow distribution, wherein the first treatment fluid meets the stimulation criteria; stimulate the subsurface formation with the first treatment fluid; monitor the flow distribution based on the stimulation; determine whether the second flow distribution meets the stimulation criteria; and stimulate the subsurface formation with a second treatment fluid based on the determination that the second flow distribution does not meet the stimulation criteria.

Embodiment 33: The one or more non-transitory machine-readable media of Embodiment 32, wherein the program code to monitor a first flow distribution to one or more entry points into a subsurface formation comprises program code to detect signals from one or more tracers associated with perforation plugs flowing in the subsurface formation at various locations in the subsurface formation.

Embodiment 34: The one or more non-transitory machine-readable media of Embodiment 32 or 33, wherein the one or more tracers are electronic chips embedded in the perforation plugs.

Embodiment 35: The one or more non-transitory machine-readable media of any of Embodiments 32-34, further comprising program code to monitor a pressure signal in the subsurface formation and wherein the program code to determine characteristics associated with first treatment fluid to be injected into the wellbore based on the flow distribution to meet the stimulation criteria comprises program code to determine at least one characteristics associated with the first treatment fluid to be injected into the wellbore based on the pressure signal.

Embodiment 36: The one or more non-transitory machine-readable media of Embodiments 32-35, wherein the program code to monitor the pressure signal in the subsurface formation comprises program code to detect the pressure signal from one or more tracers associated with perforation plugs flowing in the subsurface formation at various locations in the subsurface formation.

Embodiment 37: The one or more non-transitory machine-readable media of Embodiments 32-36, wherein the first treatment fluid has a stimulation additive of a first size and the second treatment fluid has a stimulation additive of a second size, and wherein the program code to stimulate the subsurface formation with the first treatment fluid comprises program code to stimulate the subsurface formation with the first treatment fluid to form microfractures and to stimulate the subsurface formation with the second treatment fluid to prop, control leakoff, reduce friction pressure, or initiate fractures.

Embodiment 38: A system comprising: a sensor; a processor; and a machine readable medium having program code executable by the processor to cause the processor to: monitor, by the sensor, a first flow distribution to one or more entry points into a subsurface formation; identify stimulation criteria based on the first flow distribution; determine at least one characteristic associated with a first treatment fluid to be injected into a wellbore associated with the subsurface formation based on the first flow distribution, wherein the first treatment fluid meets the stimulation criteria; stimulate the subsurface formation with the first treatment fluid; monitor, by the sensor, a second flow distribution based on the stimulation; determine whether the second flow distribution meets the stimulation criteria; and stimulate the subsurface formation with a second treatment fluid based on the determination that the second flow distribution does not meet the stimulation criteria.

Embodiment 39: The system of Embodiment 38, wherein the sensor is one or more of a downhole listening device, a surface listening device, and an inline detector to sense signals associated with tracers of perforations plugs in the wellbore.

Embodiment 40: The system of Embodiment 38 or 39, wherein the tracers are electronic chips embedded in the perforation plugs.

What is claimed is:

1. A method comprising:

monitoring a flow distribution to one or more entry points into a subsurface formation;

identifying a plugging objective based on the flow distribution;

determining characteristics associated with plugs to be dropped into a wellbore associated with the subsurface formation based on the flow distribution, characteristics of the one or more entry points, and the plugging objective;

causing the plugs to be dropped into the wellbore, wherein the plugs have tracers; and detecting based on the tracers whether the plugs reached a location associated with the one or more entry points.

2. The method of claim 1, further comprising:

based on the plugs reaching the location, monitoring a new flow distribution to the one or more entry points;

determining whether the new flow distribution meets the plugging objective;

based on the new flow distribution meeting the plugging objective, continuing a stimulation treatment; and based on the new flow distribution not meeting the plugging objective, adjusting the new flow distribution.

3. The method of claim 1, wherein the one or more entry points comprises one or more clusters of perforations; and wherein determining characteristics associated with plugs to be dropped into the wellbore comprises inputting at least one of a number of perforations in the one or more clusters, a density of perforations in the one or more clusters, a size of the perforations in the one or more clusters, a shape of the perforations in the one or more clusters, the flow distribution to the one or more clusters, and the plugging objective into a model which outputs the characteristics associated with the perforation plugs to be dropped into the wellbore, wherein the characteristics comprise a size of the perforation plugs.

4. The method of claim 1, wherein a density of the plugs is based on at least one of a density of fluid in the subsurface formation, a location of the one or more entry points, and the flow distribution.

5. The method of claim 1, wherein detecting based on the tracers comprises measuring a strength of acoustic signals from the plugs; and determining that the plugs reached the one or more entry points based on the strength exceeding a threshold.

6. The method of claim 1, wherein detecting based on the tracers comprises receiving via a sensor disposed at the one or more entry points unique signals from the plugs;

counting a number of the unique signals; and determining whether the number exceeds a threshold.

7. The method of claim 6, wherein the unique signals are output by at least one of a Radio Frequency Identification (RFID) and a Near Field Communication (NFC) associated with the tracers.

8. The method of claim 1, wherein the plugs comprise first plugs of a first buoyancy and second plugs of a second buoyancy dropped from a surface or downhole, and wherein dropping the plugs comprises dropping the first plugs with the first buoyancy and then dropping the second plugs with the second buoyancy.

9. The method of claim 1, wherein detecting based on the tracers comprises receiving a pressure signal or a chemical from the plugs indicative of the plugs being wedged into the one or more entry points.

10. The method of claim 1, wherein the tracers are electronic chips embedded in the plugs.

11. One or more non-transitory machine-readable media comprising program code, the program code executable by a processor to cause the processor to operate a perforation plug controller to:

monitor a flow distribution to one or more entry points into a subsurface formation;

identify a plugging objective based on the flow distribution;

determine characteristics associated with plugs to be dropped into a wellbore associated with the subsurface formation based on the flow distribution, characteristics of the one or more entry points, and the plugging objective;

cause the plugs to be dropped into the wellbore, wherein the plugs have tracers; and detect based on the tracers whether the plugs reached a location associated with the one or more entry points.

12. The one or more non-transitory machine-readable media of claim 11, wherein the one or more entry points comprises one or more clusters of perforations; and wherein the program code to determine characteristics associated with plugs to be dropped into the wellbore comprises inputting at least one of a number of perforations in the one or more clusters, a density of perforations in the one or more clusters, a size of the perforations in the one or more clusters, a shape of the perforations in the one or more clusters, the flow distribution to the one or more clusters, and the plugging objective into a model which outputs the characteristics associated with the perforation plugs to be dropped into the wellbore, wherein the characteristics comprise a size of the perforation plugs.

13. The one or more non-transitory machine-readable media of claim 11, wherein the one or more entry points comprises one or more clusters of perforations.

14. The one or more non-transitory machine-readable media of claim 11, wherein the program code to detect based on the tracers comprises program code to measure a strength of acoustic signals from the plugs; and determine that the plugs reached the one or more entry points based on the strength exceeding a threshold.

15. The one or more non-transitory machine-readable media of claim 11, wherein the program code to detect based on the tracers comprises program code to receive via a sensor disposed at the one or more entry points unique signals from the plugs; count a number of the unique signals; and determine whether the number exceeds a threshold.

16. The one or more non-transitory machine-readable media of claim 15, wherein the unique signals are output by at least one of a Radio Frequency Identification (RFID) and a Near Field Communication (NFC) associated with the tracers.

17. The one or more non-transitory machine-readable media of claim 11, wherein the plugs comprise first plugs of a first buoyancy and second plugs of a second buoyancy dropped from a surface or downhole, wherein dropping the plugs comprises dropping the first plugs with the first buoyancy and then dropping the second plugs with the second buoyancy.

18. The one or more non-transitory machine-readable media of claim 11, wherein the tracers are electronic chips embedded in the plugs.

19. A system comprising:

a number of plugs having a tracer;

a sensor;

a processor; and a machine readable medium having program code executable by the processor to cause the processor to:

monitor, by the sensor, a flow distribution to one or more entry points into a subsurface formation;

identify a plugging objective based on the flow distribution;

determine characteristics associated with the number of plugs to be dropped into a wellbore associated with the subsurface formation based on the flow distribution, characteristics of the one or more entry points, and the plugging objective;

cause the number of plugs to be dropped into the wellbore; and detect, by the sensor, based on the tracer of the number of plugs whether the number of plugs reached a location associated with the one or more entry points.

20. The system of claim 19, wherein the sensor is one or more of a downhole listening device, a surface listening device, or an inline detector for sensing signals associated with the tracers.

* * * * *